US010705481B2

(12) United States Patent
Sugimoto et al.

(10) Patent No.: US 10,705,481 B2
(45) Date of Patent: Jul. 7, 2020

(54) PROCESS CARTRIDGE

(71) Applicant: CANON KABUSHIKI KAISHA, Tokyo (JP)

(72) Inventors: Sohta Sugimoto, Yokohama (JP); Kenji Hasegawa, Yokohama (JP); Masanari Morioka, Yokohama (JP); Yasuyuki Egami, Tokyo (JP); Tetsushi Uneme, Kawasaki (JP); Naoki Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/299,318

(22) Filed: Mar. 12, 2019

(65) Prior Publication Data

US 2019/0286051 A1 Sep. 19, 2019

(30) Foreign Application Priority Data

Mar. 13, 2018 (JP) ..... 2018-045189

(51) Int. Cl.
*G03G 21/18* (2006.01)
*G03G 21/16* (2006.01)

(52) U.S. Cl.
CPC ..... *G03G 21/1864* (2013.01); *G03G 21/1647* (2013.01); *G03G 21/1825* (2013.01); *G03G 2221/1657* (2013.01)

(58) Field of Classification Search
CPC ..... G03G 21/1857; G03G 21/1864; G03G 21/1647; G03G 21/1825; G03G 2221/1657
See application file for complete search history.

(56) References Cited

U.S. PATENT DOCUMENTS 6,704,522 B2 3/2004 Sasago et al.
6,714,746 B2 3/2004 Morioka et al.
6,898,399 B2 5/2005 Morioka et al.
(Continued)

FOREIGN PATENT DOCUMENTS

JP 2001-337511 A 12/2001
JP 2007-213023 A 8/2007
JP 2014-021195 A 2/2014

OTHER PUBLICATIONS

Co-pending U.S. Appl. No. 16/360,147, filed Mar. 21, 2019.
Co-pending U.S. Appl. No. 16/234,808, filed Dec. 28, 2018.

*Primary Examiner* — Carla J Therrien
(74) *Attorney, Agent, or Firm* — Venable LLP

(57) ABSTRACT

A cartridge detachably mountable to a main assembly of an image forming apparatus includes a drum unit including a photosensitive drum; a developing unit including a developing roller, a driving force receiving portion, and a development gear; a driving train for transmitting the driving force to the development gear. The developing roller is movable between a contact position and spacing position relative to the drum. The driving train includes a first driving portion connected with the driving force receiving portion and a second driving portion for transmitting the driving force toward the gear. When the developing unit is in the contact position, the first and second driving portions are connected with each other to transmit the driving force from the first driving portion to the second driving portion, and when the developing unit is in the spacing position, the first and the driving portion are not connected.

8 Claims, 34 Drawing Sheets

(56) References Cited

U.S. PATENT DOCUMENTS 6,937,832 B2 8/2005 Sato et al.
6,963,706 B2 11/2005 Morioka et al.
7,079,787 B2 7/2006 Ogino et al.
7,127,192 B2 10/2006 Batori et al.
7,200,349 B2 4/2007 Sato et al.
7,418,225 B2 8/2008 Morioka et al.
8,135,304 B2 3/2012 Abe et al.
8,270,876 B2 9/2012 Morioka et al.
8,275,283 B2 9/2012 Uneme et al.
8,275,286 B2 9/2012 Ueno et al.
8,280,278 B2 10/2012 Ueno et al.
8,295,734 B2 10/2012 Ueno et al.
8,401,441 B2 3/2013 Uneme et al.
8,422,914 B2 4/2013 Hayashi et al.
8,437,669 B2 5/2013 Morioka et al.
8,452,210 B2 5/2013 Ueno et al.
8,472,840 B2 6/2013 Abe et al.
8,483,589 B2 7/2013 Uneme et al.
8,532,533 B2 9/2013 Ueno et al.
8,630,564 B2 1/2014 Ueno et al.
8,676,090 B1 3/2014 Ueno et al.
8,682,215 B1 3/2014 Ueno et al.
8,688,008 B2 4/2014 Norioka et al.
9,025,998 B2 5/2015 Morioka et al.
9,128,417 B2 9/2015 Yamasaki et al.
9,164,419 B2 10/2015 Uneme
9,176,468 B2 11/2015 Ueno et al.
9,213,306 B2 12/2015 Morioka et al.
9,256,161 B2 2/2016 Hayashi et al.
9,274,499 B2 3/2016 Morioka et al.
9,377,716 B2 6/2016 Yamasaki et al.
9,465,318 B2 10/2016 Takeuchi et al.
9,501,031 B2 11/2016 Hayashi et al.
9,523,942 B2 12/2016 Takeuchi et al.
9,632,451 B2 4/2017 Hayashi et al.
9,678,471 B2 6/2017 Ueno et al.
9,684,261 B2 6/2017 Miyabe et al.
9,703,257 B2 7/2017 Morioka et al.
9,733,614 B2 8/2017 Ueno et al.
9,746,826 B2 8/2017 Ueno et al.
9,772,602 B2 9/2017 Ueno et al.
9,785,091 B2 10/2017 Fukasawa et al.
9,817,333 B2 11/2017 Morioka et al.
9,836,015 B2 12/2017 Morioka et al.
9,836,021 B2 12/2017 Ueno et al.
9,840,724 B2 12/2017 Anthony et al.
9,841,727 B2 12/2017 Ueno et al.
9,841,728 B2 12/2017 Ueno et al.
9,841,729 B2 12/2017 Ueno et al.
9,846,408 B2 12/2017 Ueno et al.
9,851,685 B2 12/2017 Morioka et al.
9,851,688 B2 12/2017 Morioka et al.
9,857,764 B2 1/2018 Ueno et al.
9,857,765 B2 1/2018 Ueno et al.
9,857,766 B2 1/2018 Morioka et al.
9,864,331 B2 1/2018 Ueno et al.
9,864,333 B2 1/2018 Ueno et al.
9,869,960 B2 1/2018 Ueno et al.
9,874,846 B2 1/2018 Ueno et al.
9,874,854 B2 1/2018 Ueno et al.
9,886,002 B2 2/2018 Morioka et al.
9,939,776 B2 4/2018 Morioka et al.
9,989,892 B2 6/2018 Takeuchi et al.
10,133,215 B2 11/2018 Fukasawa et al.
10,168,665 B2 1/2019 Miyabe et al.
10,209,670 B2 2/2019 Ueno et al.
2007/0177899 A1 8/2007 Kawamura
2011/0026972 A1 2/2011 Kawamura
2011/0038649 A1 2/2011 Miyabe et al.
2013/0336674 A1 12/2013 Abe et al.
2014/0016957 A1 1/2014 Suzuki et al.
2015/0220020 A1 8/2015 Hayashi et al.
2016/0070199 A1* 3/2016 Oh ..... F16H 1/20 399/258
2016/0274536 A1 9/2016 Ueno et al.
2018/0046129 A1* 2/2018 Sim ..... G03G 21/1647
2018/0074454 A1 3/2018 Uneme et al.
2018/0113415 A1 4/2018 Morioka et al.
2018/0136604 A1* 5/2018 Lee ..... G03G 21/1825
2018/0335720 A1* 11/2018 Jang ..... G03G 15/0806
2018/0364640 A1 12/2018 Ueno et al.
2018/0373199 A1 12/2018 Sugimoto et al.
2019/0079448 A1 3/2019 Miyabe et al.

* cited by examiner

PROCESS CARTRIDGE

FIELD OF THE INVENTION AND RELATED ART

The present invention relates to a process cartridge (which may be referred to simply as "cartridge") which is removably installable in the main assembly of an image forming apparatus.

Here, an "image forming apparatus" means an apparatus for forming an image on a sheet of recording medium with the use of an electrophotographic image formation process. As examples of image forming apparatus, an electrophotographic copying machine, an electrophotographic printer (for example, laser beam printer, LED printer, and the like), a facsimileing apparatus, a word processor, and the like, can be included.

A "process cartridge" means a cartridge in which an electrophotographic photosensitive member (which hereafter may be referred to simply as "drum") which is an image bearing member, processing means (for example, developer bearing member (which hereafter may be referred to simply as development roller), etc., are integrally disposed, and which is removably installable in the main assembly of an image forming apparatus. There are various process cartridges. For example, there are a cartridge in which both a drum and a development roller are integrally disposed, and a cartridge in which only a drum is disposed, that is, without a development roller, a cartridge in which only a development roller is disposed, that is, without a drum. In particular, in a case where a cartridge in which only a drum is disposed is different from a cartridge in which only a development roller is disposed, the cartridge which has only a drum is sometimes referred to as a drum cartridge, whereas the cartridge which has only a development roller is sometimes referred to as a development cartridge.

In the field of an image forming apparatus, a so-called process cartridge system has been widely in use. In the process cartridge system, a drum, and processing means which is for processing the drum, are integrally disposed in a casing (or cartridge) which is removably installable in the main assembly of an image forming apparatus.

A process cartridge system makes it possible for a user of an image forming apparatus to maintain an image forming apparatus by himself (or herself), that is, without relying on a service person. Thus, it can significantly improve an image forming apparatus in operational efficiency. This is why a process cartridge system has been widely used in the field of an image forming apparatus.

There is disclosed in Japanese Laid-open Patent Application No. 2001-337511, a process cartridge which is provided with a clutch which is designed so that while an image is formed by an image forming apparatus, the clutch allows driving force to be transmitted to a development roller, whereas while no image is formed by the image forming apparatus, the clutch prevents driving force from being transmitted to the development roller.

According to Japanese Laid-open Patent Application No. 2001-337511, one of the lengthwise ends of the development roller is provided with a clutch which either transmits, or does not transmit, driving force to the development roller. Further, in order to switch a process cartridge in operational state between the one in which driving force is transmitted to the development roller, and the one in which driving force is not transmitted to the development roller, the process cartridge is provided with a crank-like mechanism which has a rotational shaft (first shaft), another shaft (second shaft) which is parallel to the rotational shaft and is offset from the first one, and portions which connect the two shaft.

SUMMARY OF THE INVENTION

According to the present invention, there is provided a cartridge detachably mountable to a main assembly of an image forming apparatus, said cartridge comprising a drum unit including a photosensitive drum; a developing unit including a developing roller, a driving force receiving portion for receiving a driving force for rotating said developing roller from the main assembly, and a development gear fixed at a longitudinal end portion of said developing roller, wherein said developing unit is connected with said drum unit with said developing roller being movable between a contact position in which said developing roller contacts said photosensitive drum and a spacing position in which said developing roller is spaced from said photosensitive drum; a driving train configured to transmit the driving force received by said driving force receiving portion, to said development gear, wherein said driving train includes a first driving portion connected with said driving force receiving portion to receive the driving force from said driving force receiving portion, and a second driving portion configured to transmit the driving force toward said development gear, wherein when said developing unit is in the contact position, said first driving portion and said second driving portion are connected with each other so as to transmit the driving force from said first driving portion to said second driving portion, and when said developing unit is in the spacing position, said first driving portion and said second driving portion are not connected with each other to prevent the driving force from being transmitted to the second driving portion from the first driving portion.

Further features of the present invention will become apparent from the following description of exemplary embodiments with reference to the attached drawings.

Figure 3:
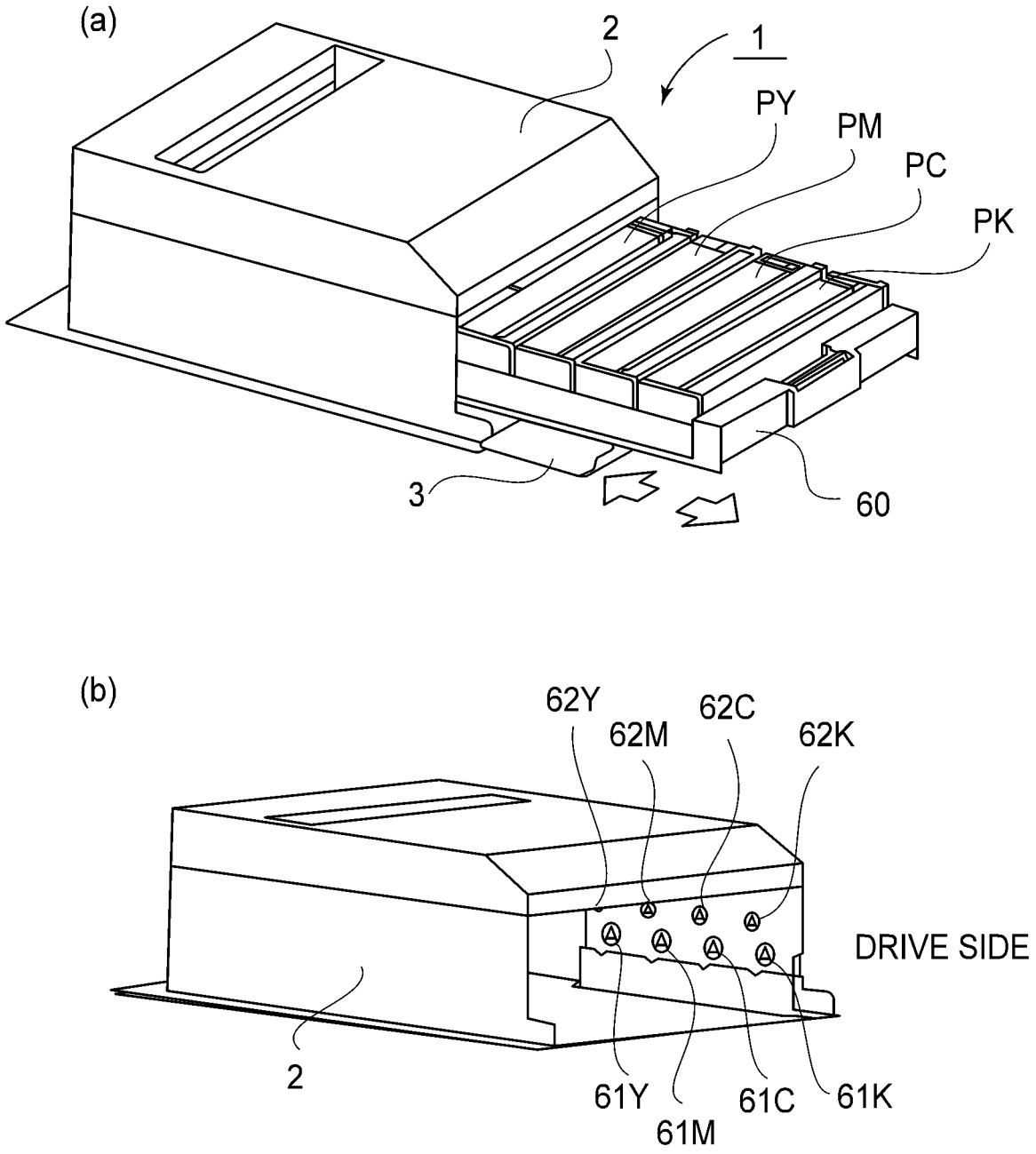

Parts (a) and (b) of FIG. 3 are perspective views of an essential portion of the main assembly of the image forming apparatus in the first embodiment.

Figure 4:
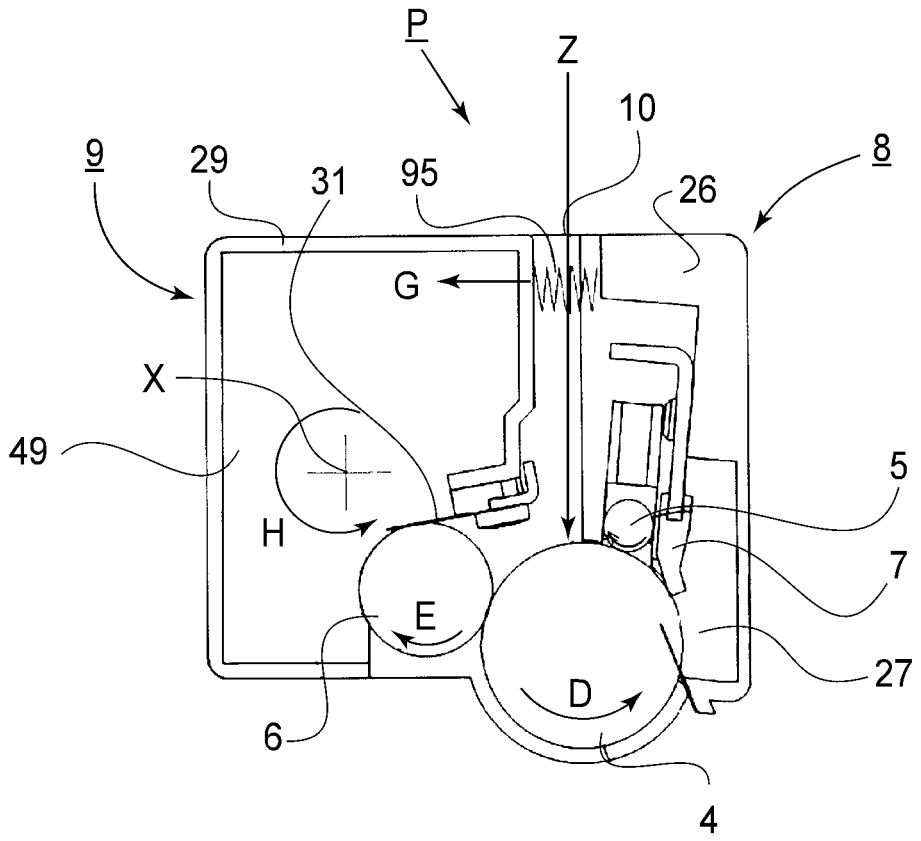

FIG. 4 is a sectional view of the process cartridge in the first embodiment.

Figure 5:
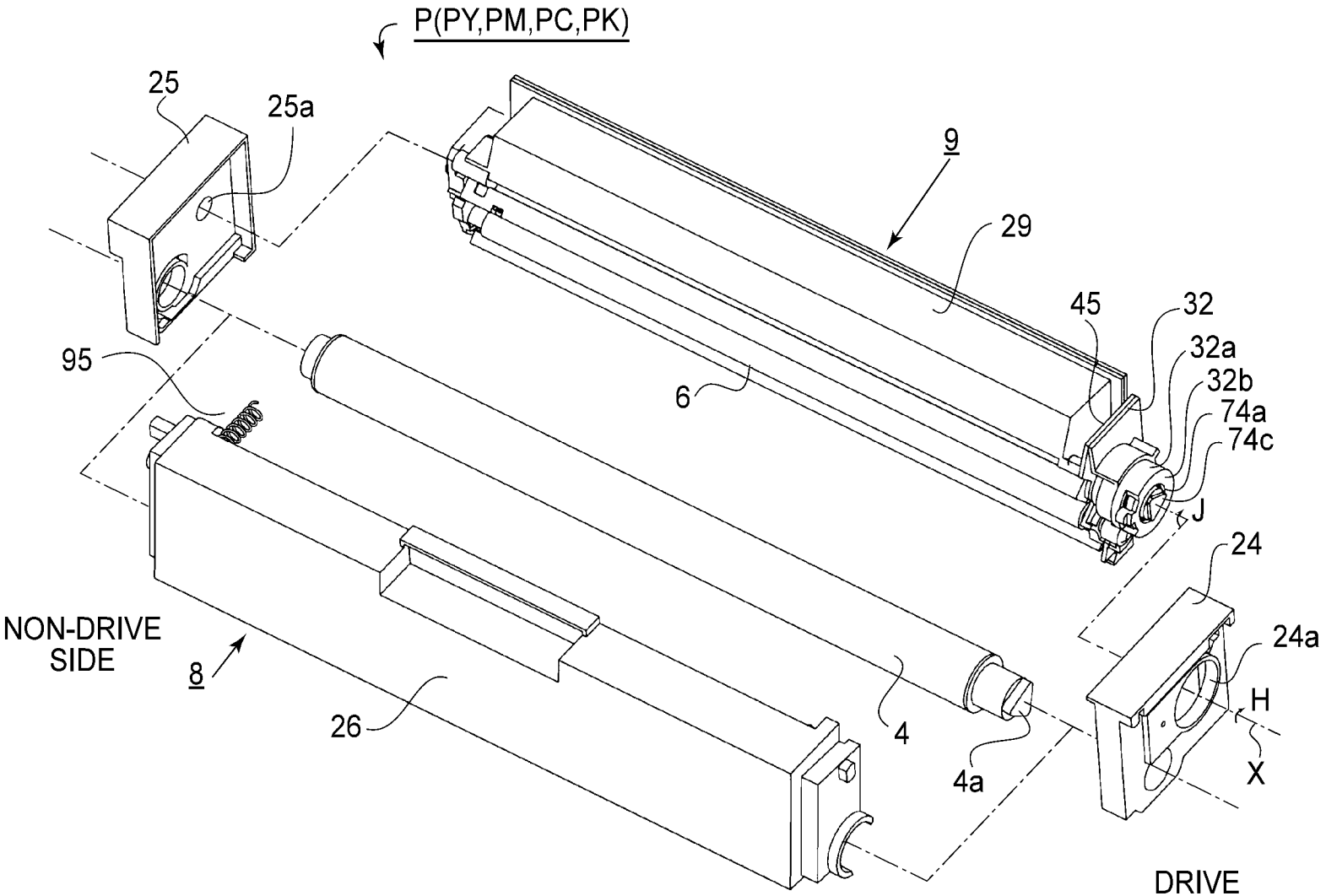

FIG. 5 is an exploded perspective view of the process cartridge in the first embodiment.

Figure 6:
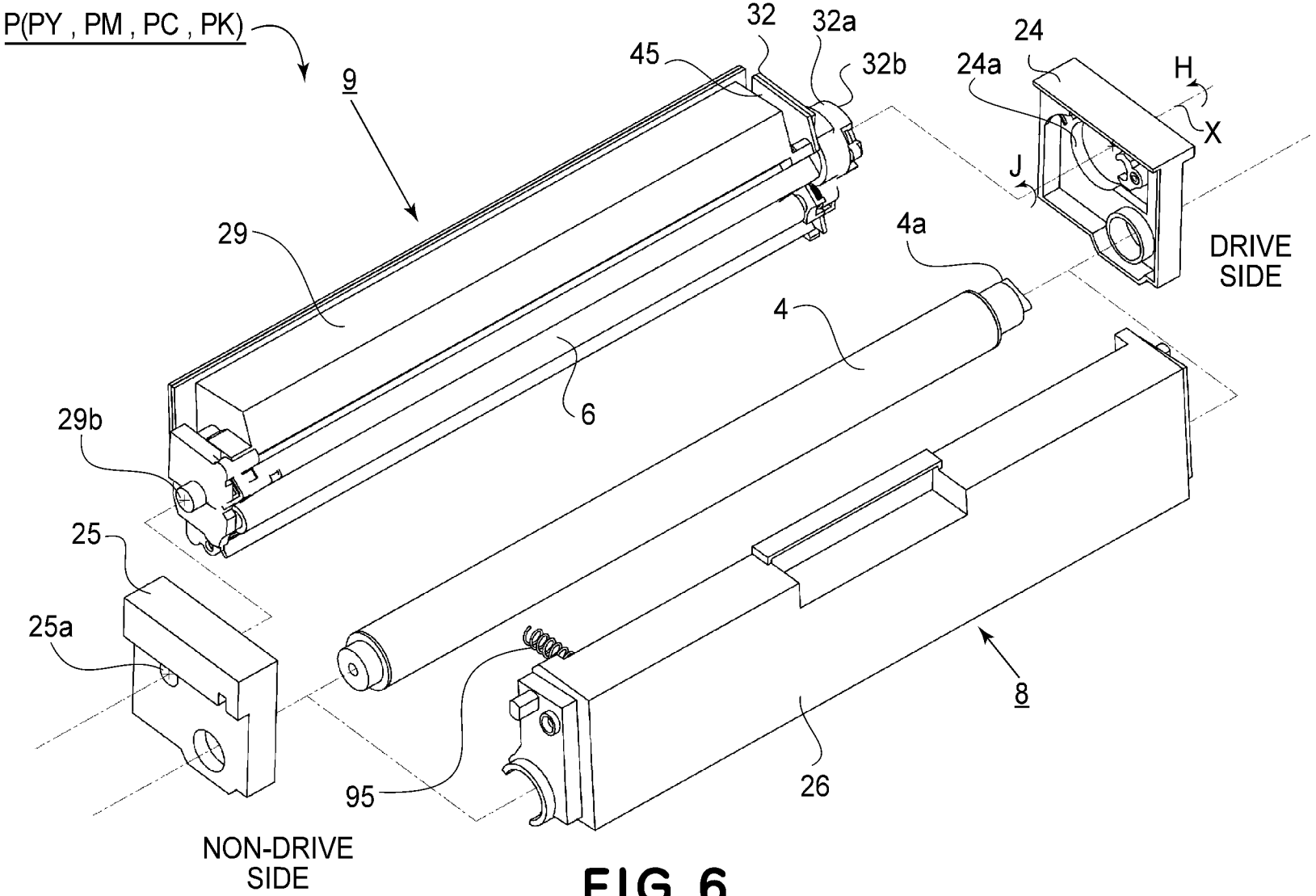

FIG. 6 also is an exploded perspective view of the process cartridge in the first embodiment.

Figure 7A:
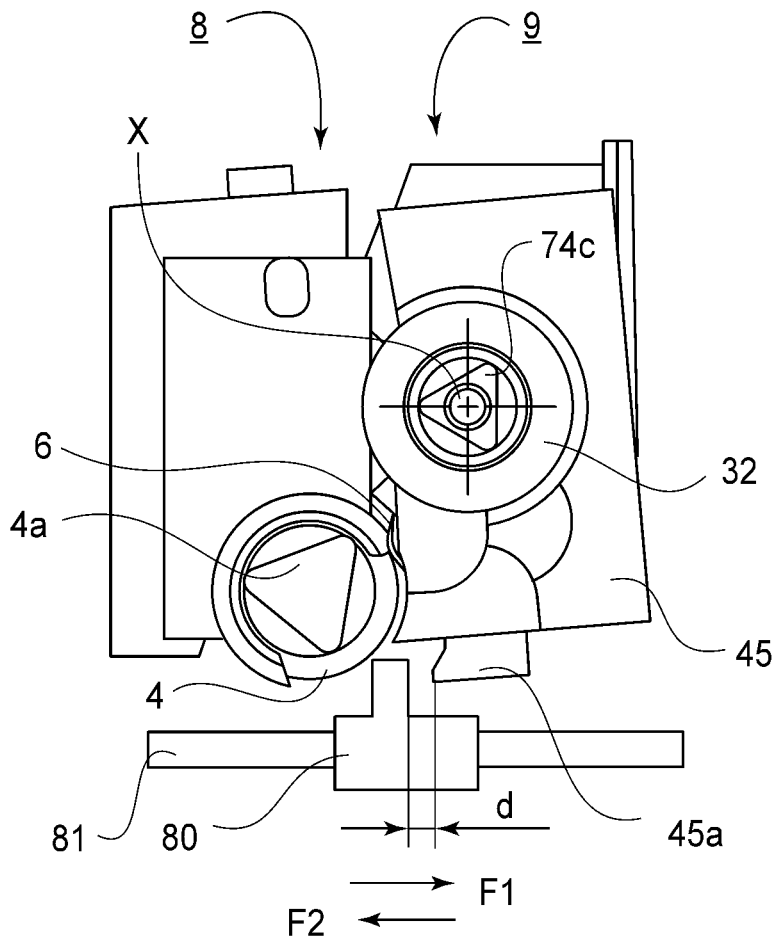
Figure 7B:
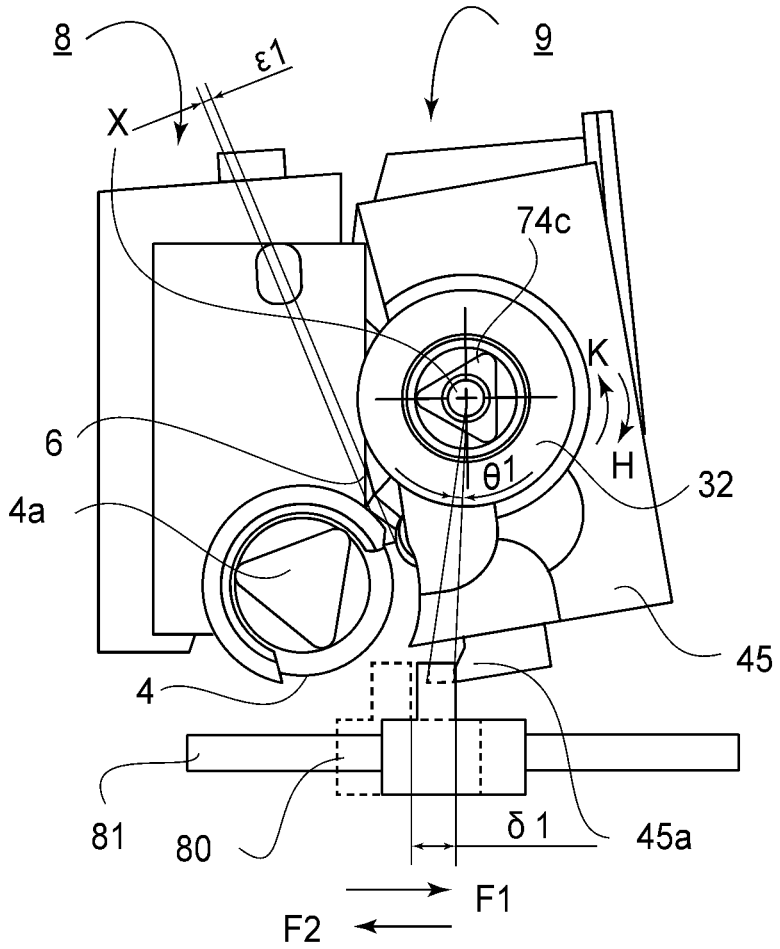
Figure 7C:
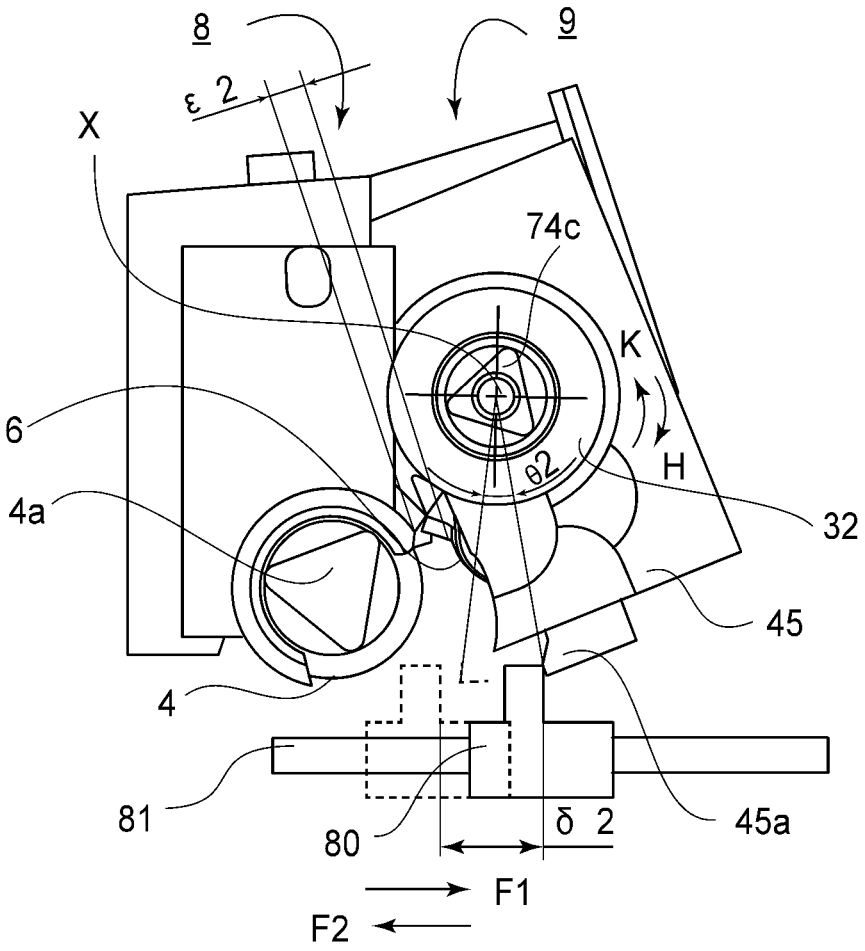

FIGS. 7A, 7B and 7C are side views of the process cartridge in this first embodiment.

Figure 8:
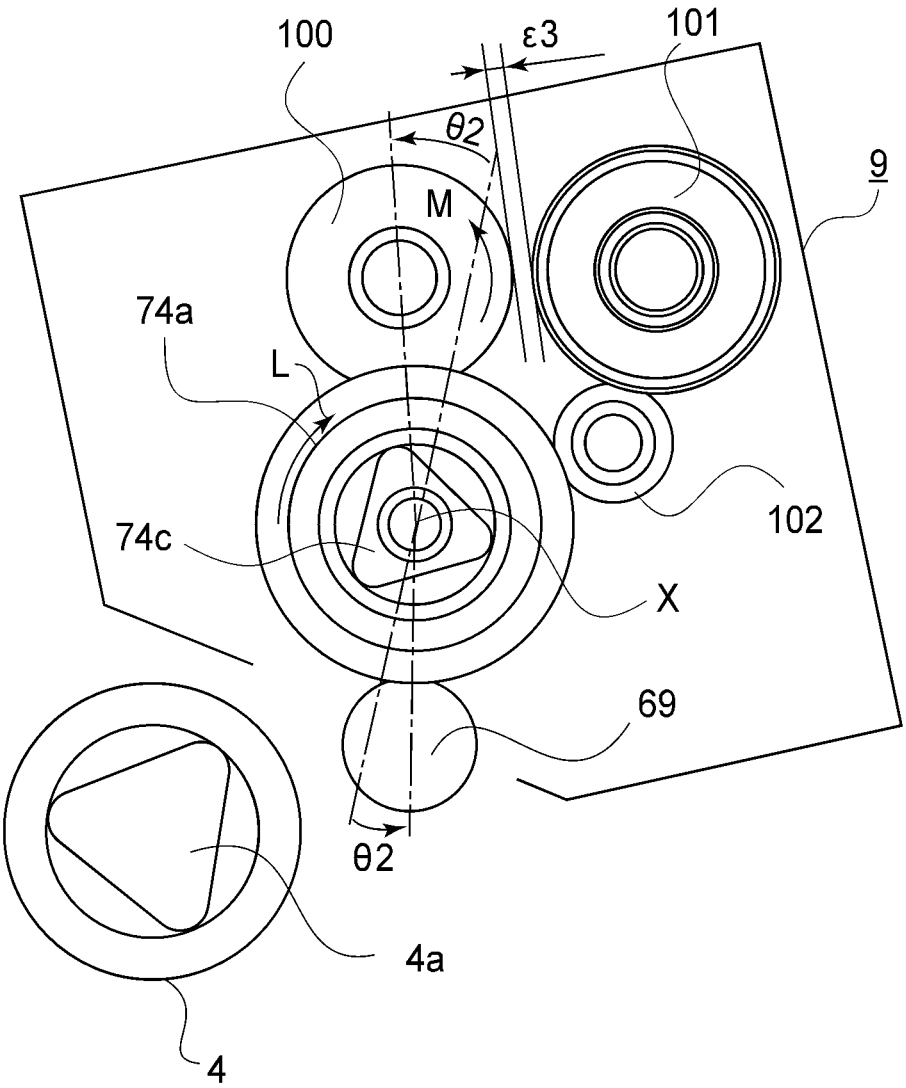

FIG. 8 is a sectional view of a combination of the development unit and drum in the first embodiment, when the development roller is separated from the drum.

Figure 9:
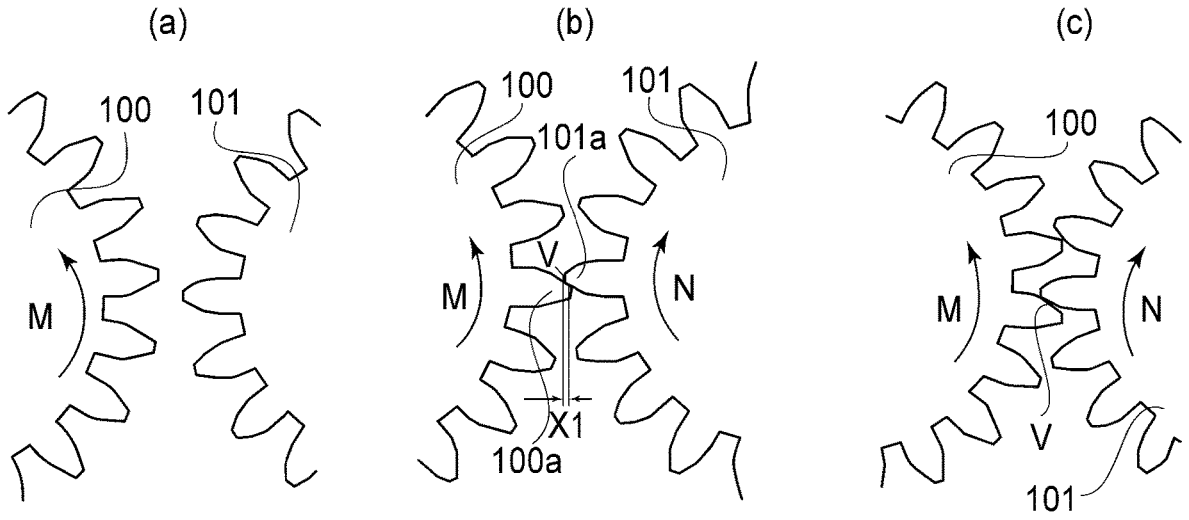

Parts (a), (b) and (c) of FIG. 9 are side views of a combination of the driving force transmission gear of the development unit, and the driving force transmission gear of the drum unit (cleaning unit), when the two gears are separated from each other, when the two gears began to mesh with each other, and when the two gears are fully meshed with each other, respectively.

Figure 10:
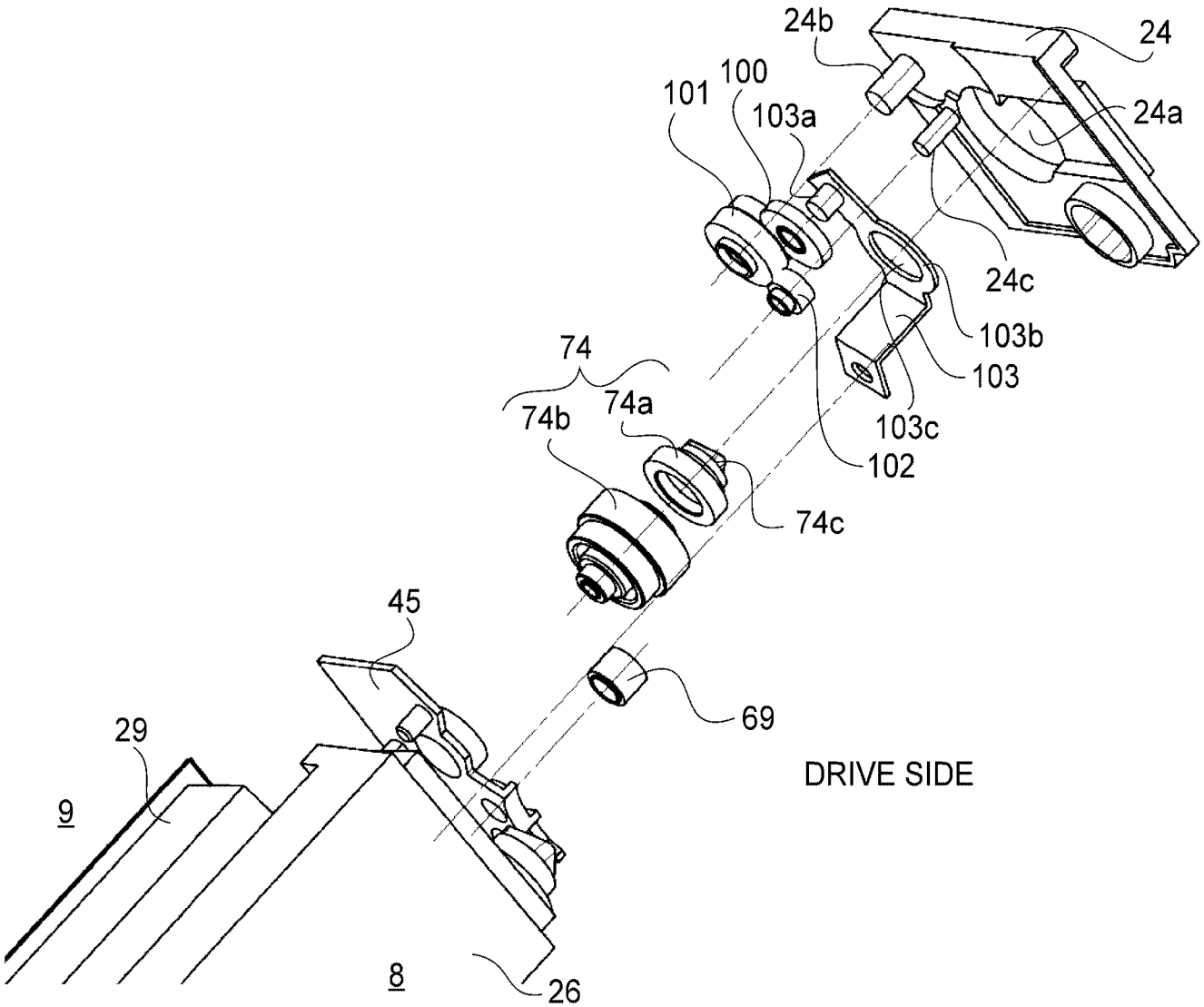

FIG. 10 is an exploded perspective view of the development unit in the first embodiment.

Figure 11A:
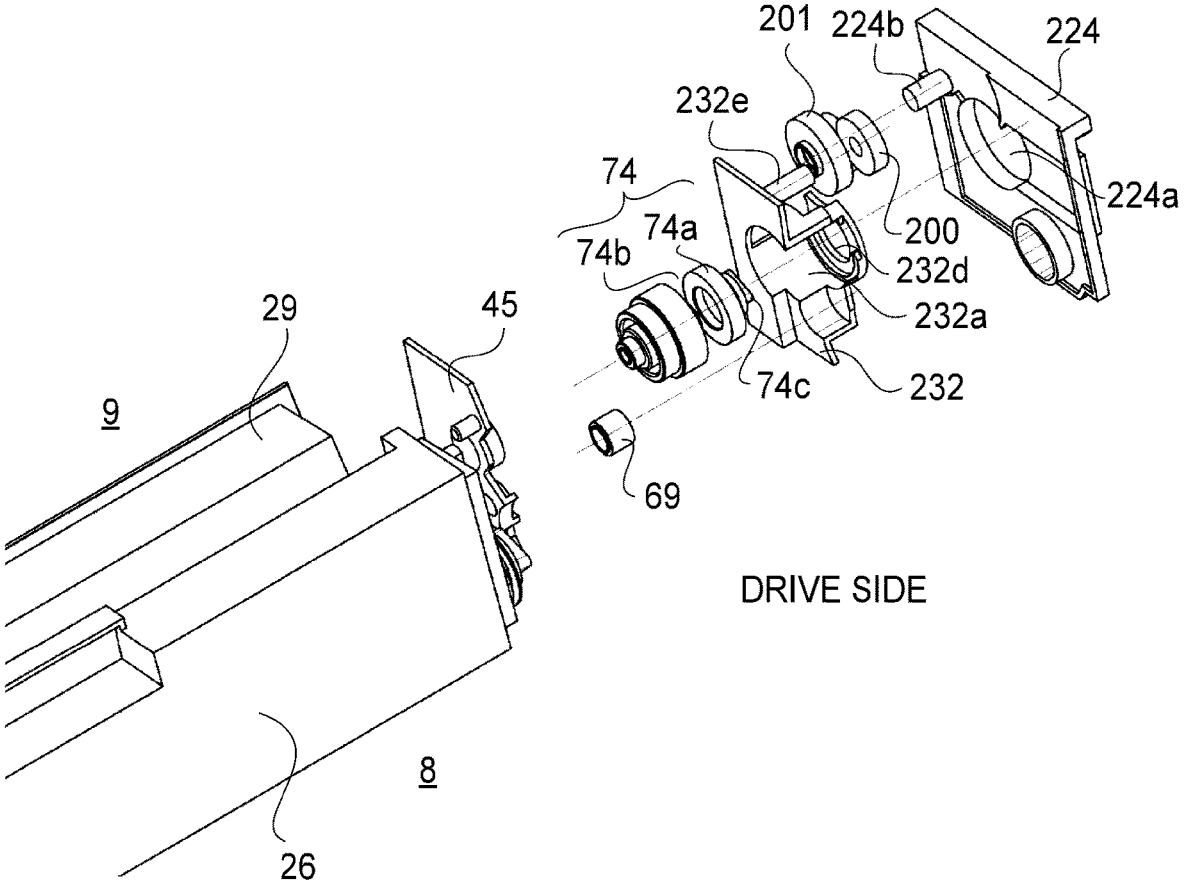
Figure 11B:
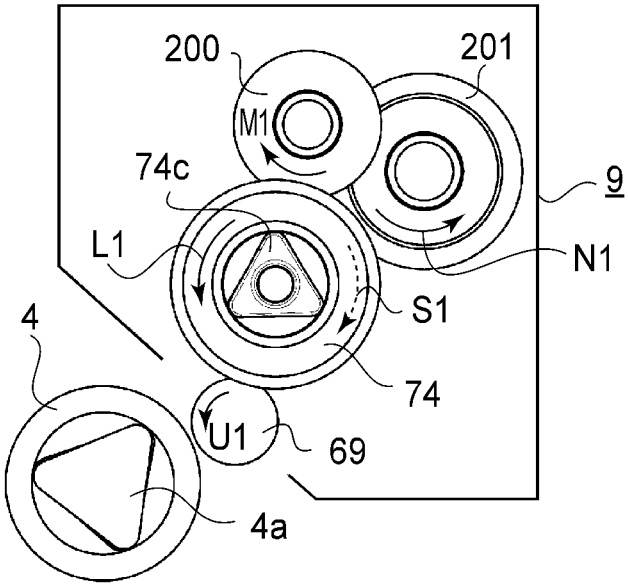

FIG. 11A is an exploded perspective view of the development unit in the first embodiment, and FIG. 11B is a sectional view of a combination of the development unit and drum in the first embodiment when the development unit is in contact with the drum unit.

Figure 12A:
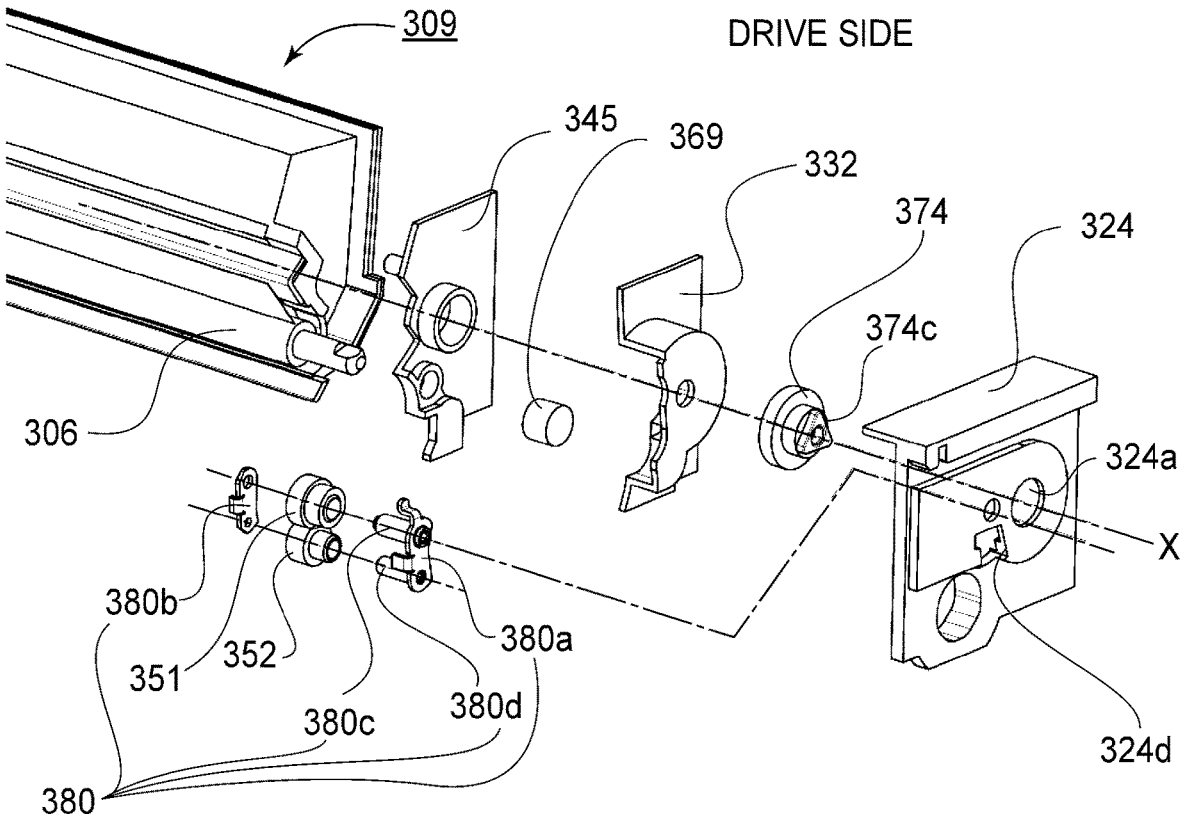
Figure 12B:
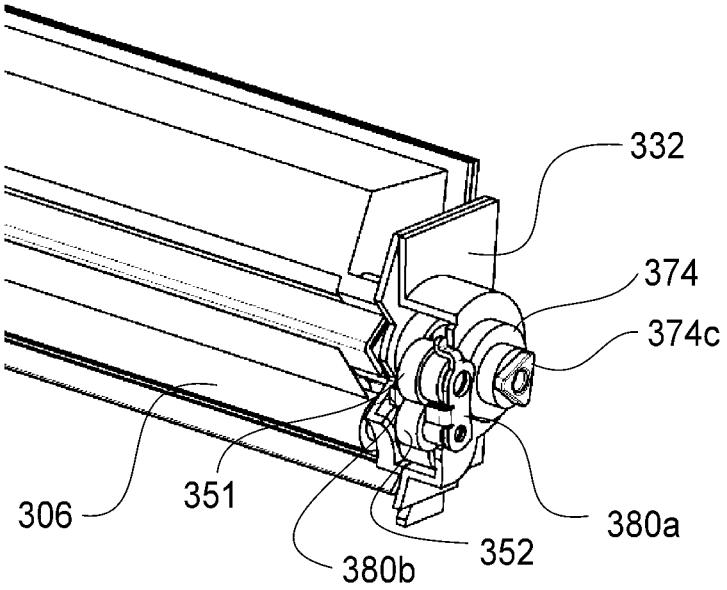
Figure 12C:
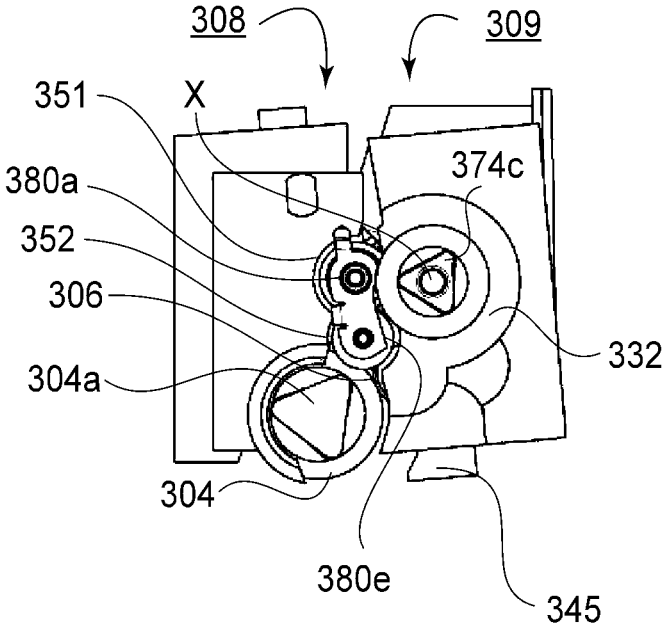

FIGS. 12A, 12B and 12C are perspective views of the process cartridge in the second embodiment of the present invention.

Figure 13A:
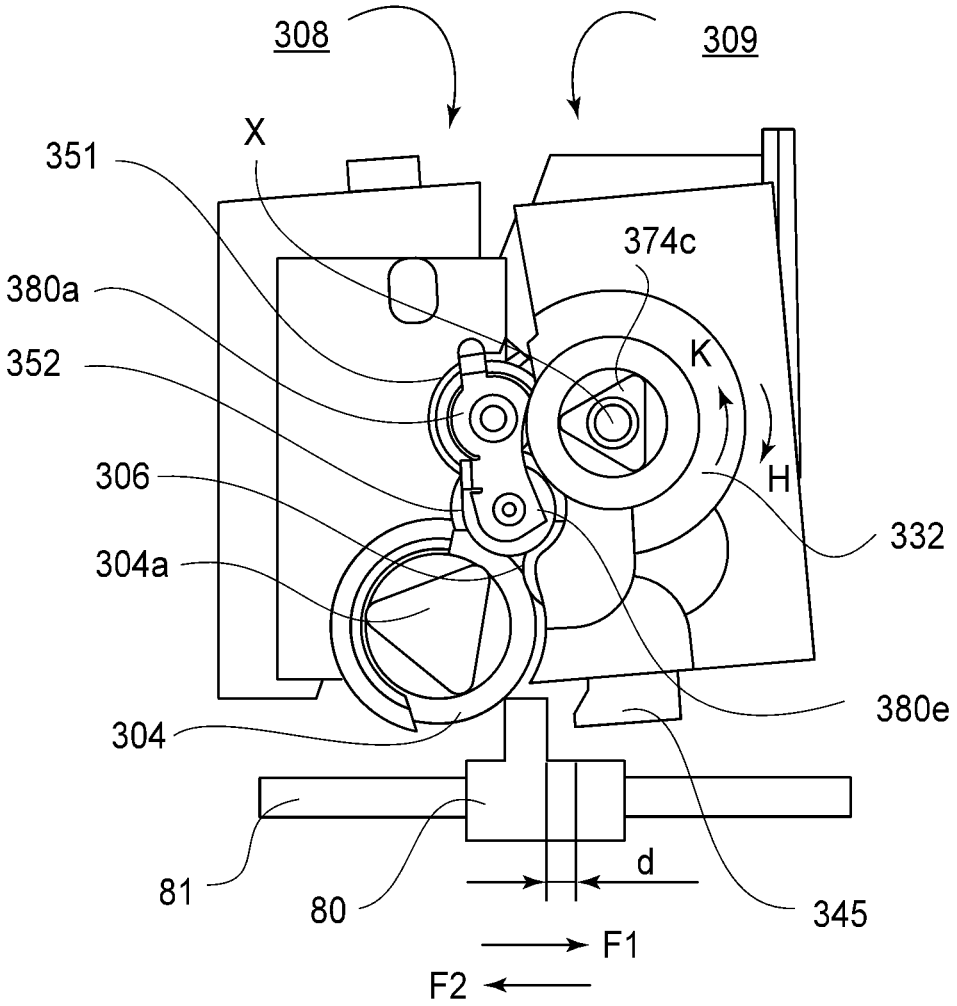
Figure 13B:
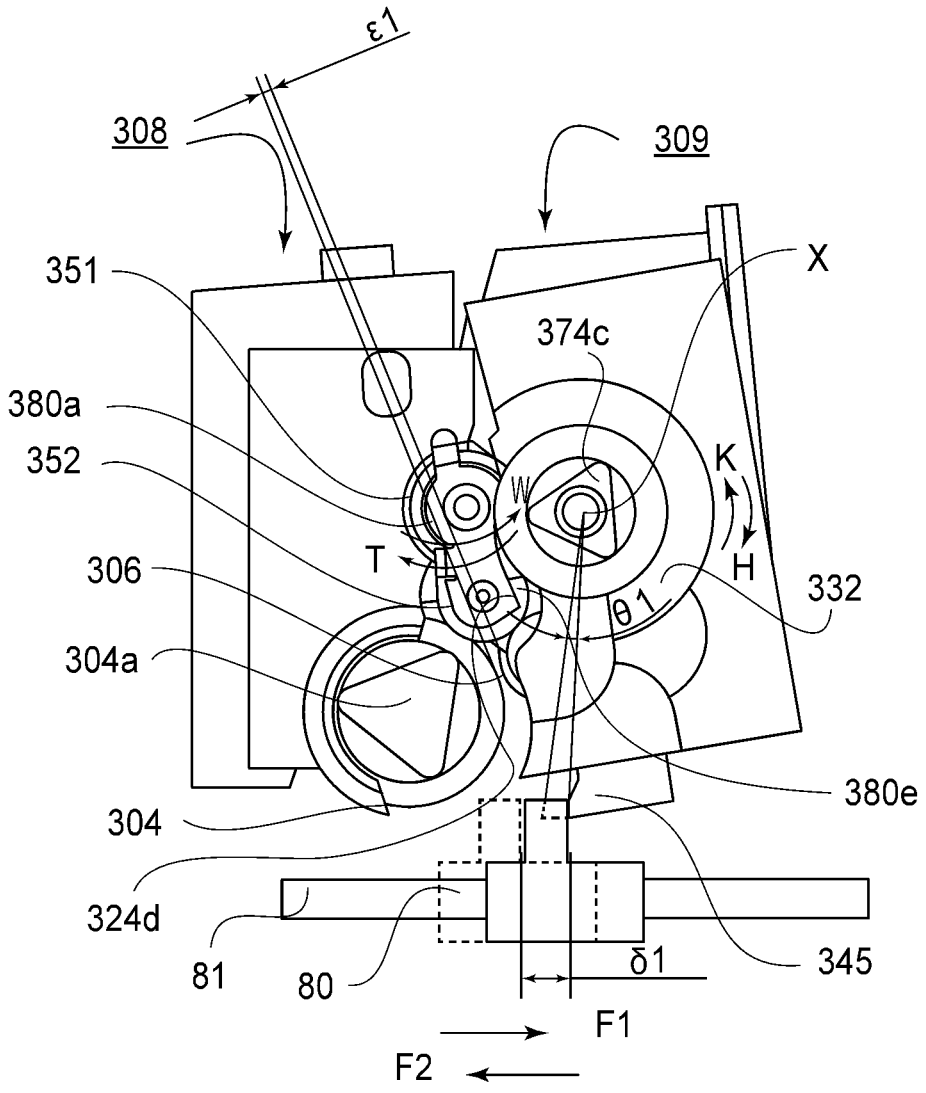
Figure 13C:
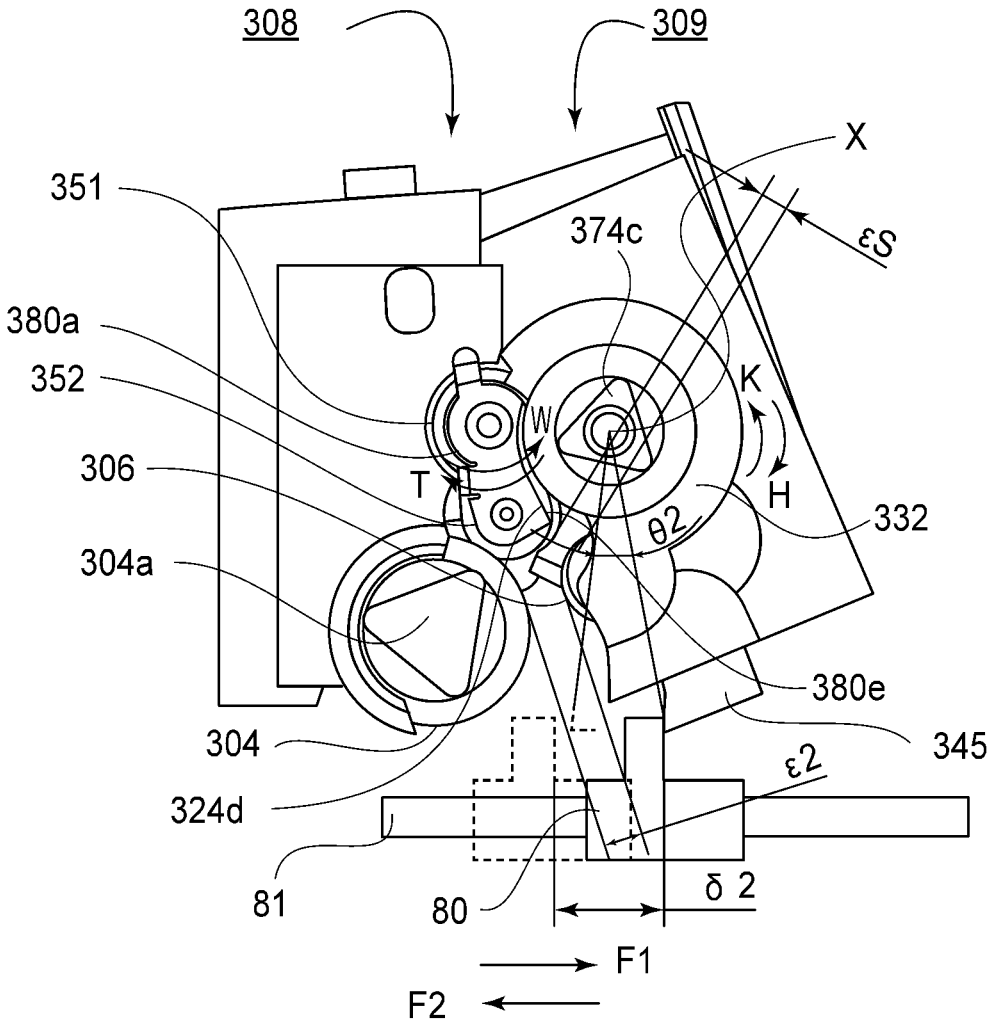

FIGS. 13A, 13B and 13C are side views of the process cartridge in the second embodiment of the present invention, when the development unit is in contact with the drum unit; FIG. 13B, when the development unit has separated from the drum unit, and the idler gear and development roller gear are in mesh with each other; and FIG. 13C is a side view of the process cartridge when the development unit has separated from the unit, and the idler gear has separated from the development roller gear.

Figure 14:
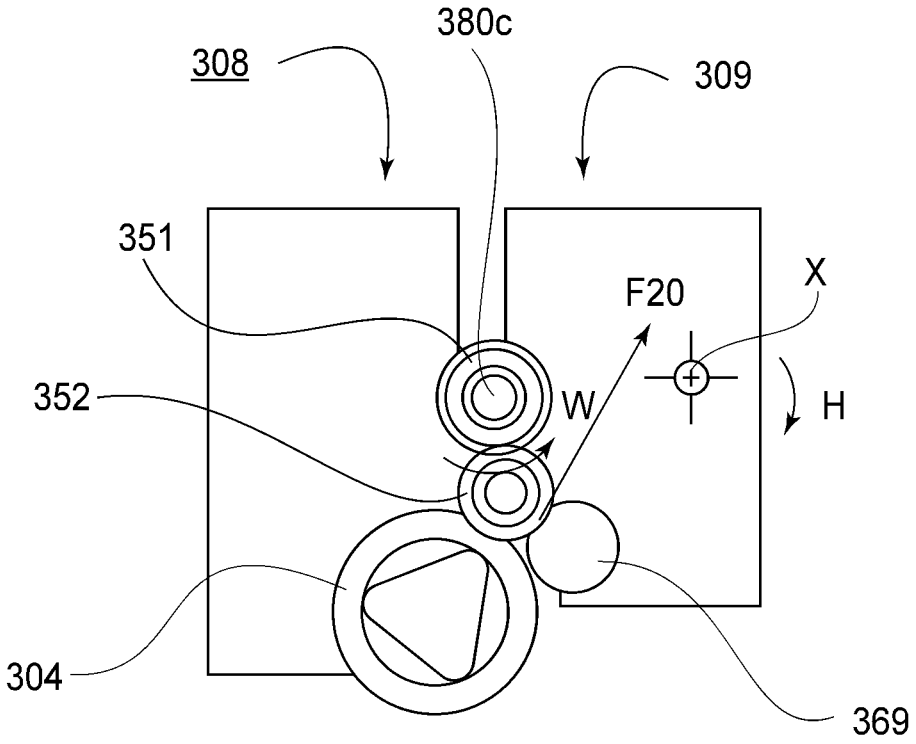

FIG. 14 is a side view of the process cartridge in the second embodiment when the gears are in mesh with each other.

Figure 15:
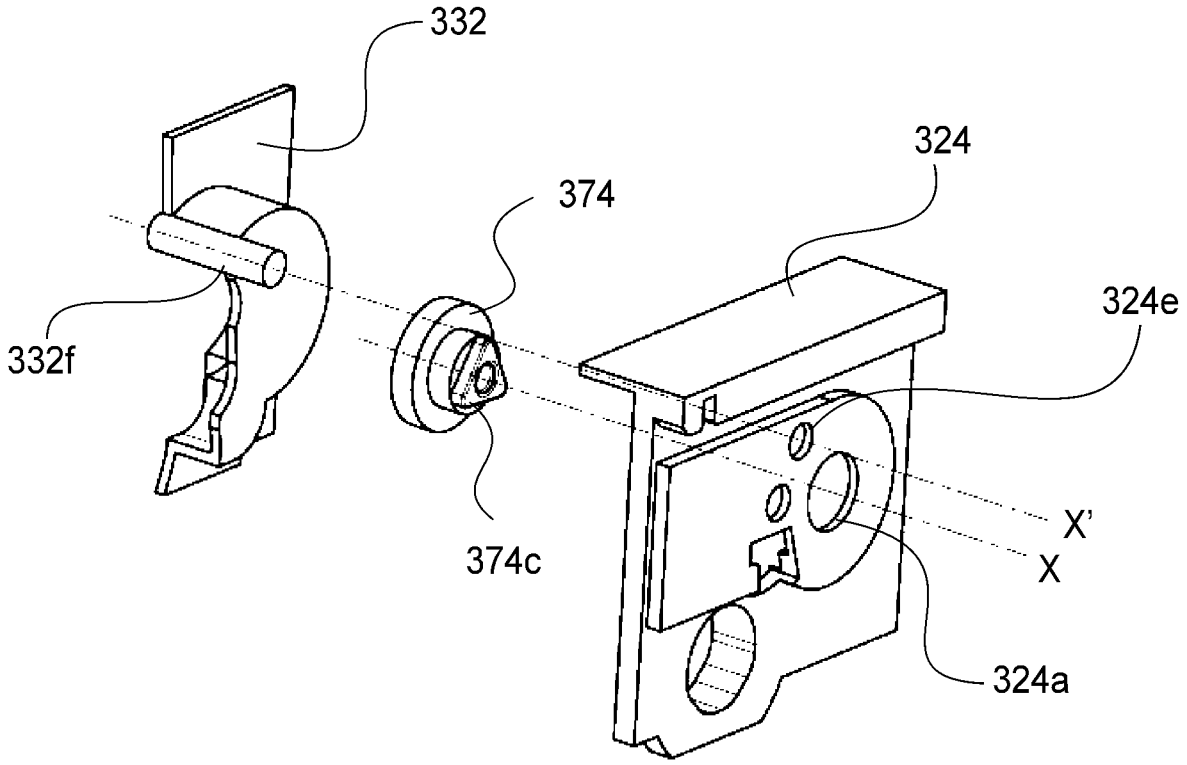

FIG. 15 is an exploded perspective view of a combination of the development covering member, development coupling gear, and cartridge covering member, in the modified version of the second embodiment, which is different in structure from the original version of the second embodiment.

Figure 16:
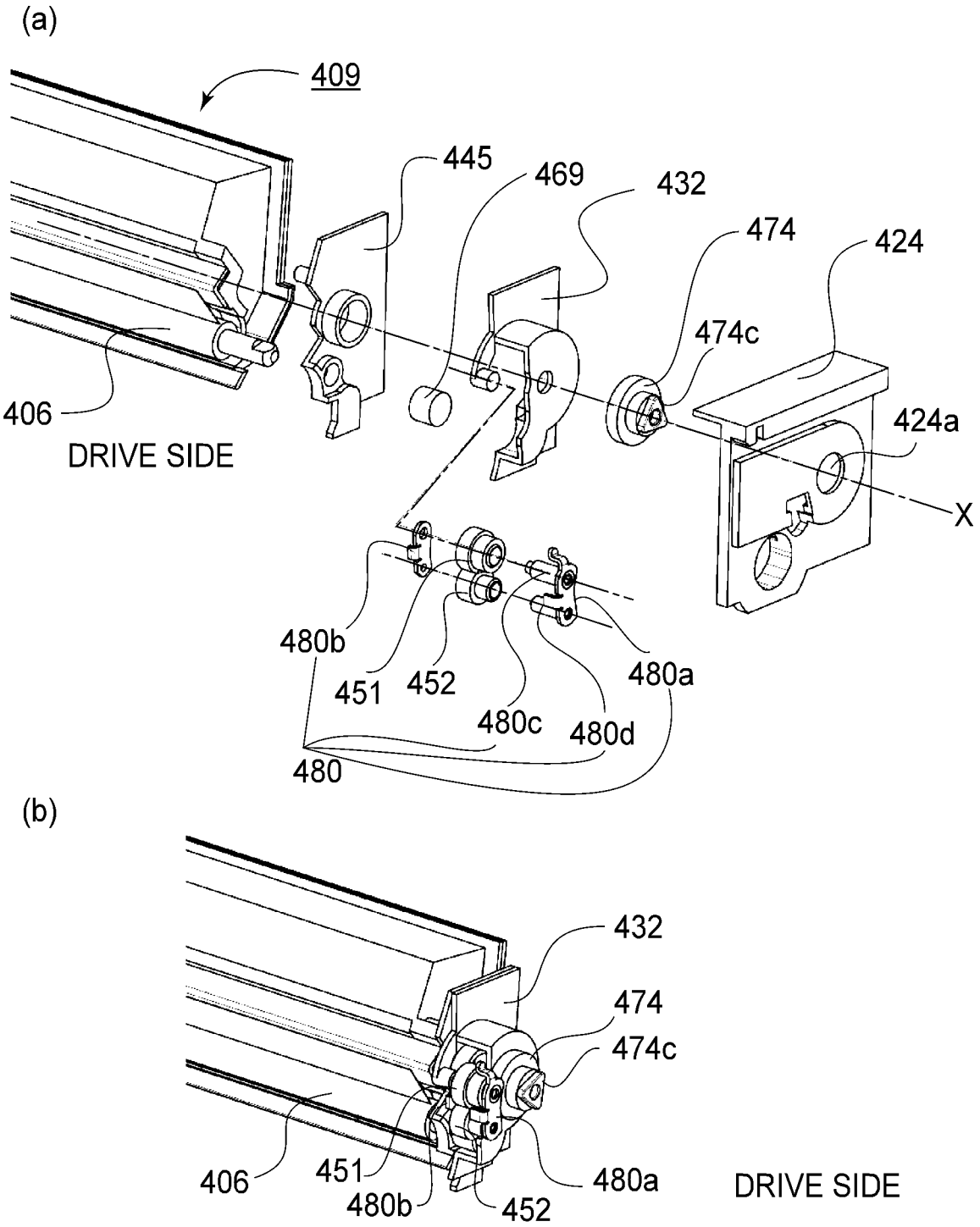

Parts (a) and (b) of FIG. 16 are perspective views of the process cartridge in the third embodiment of the present invention.

Figure 17A:
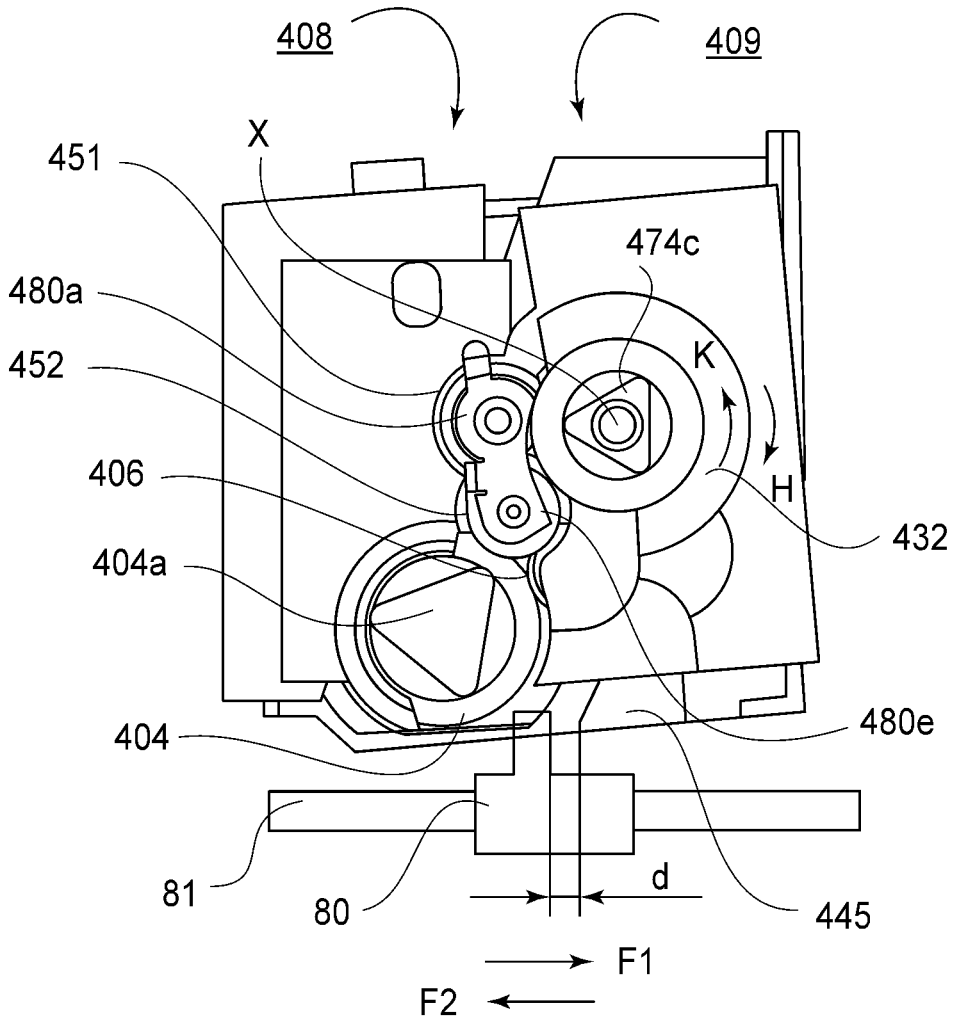
Figure 17B:
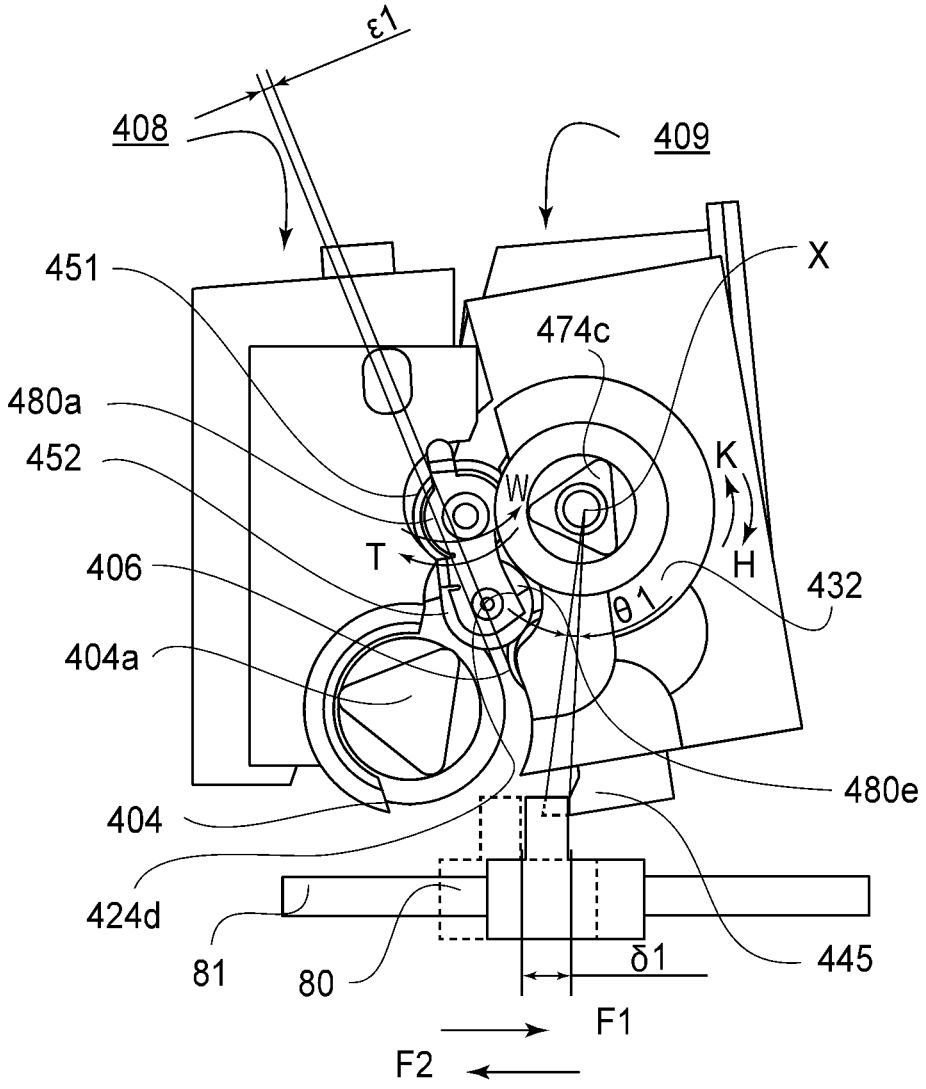
Figure 17C:
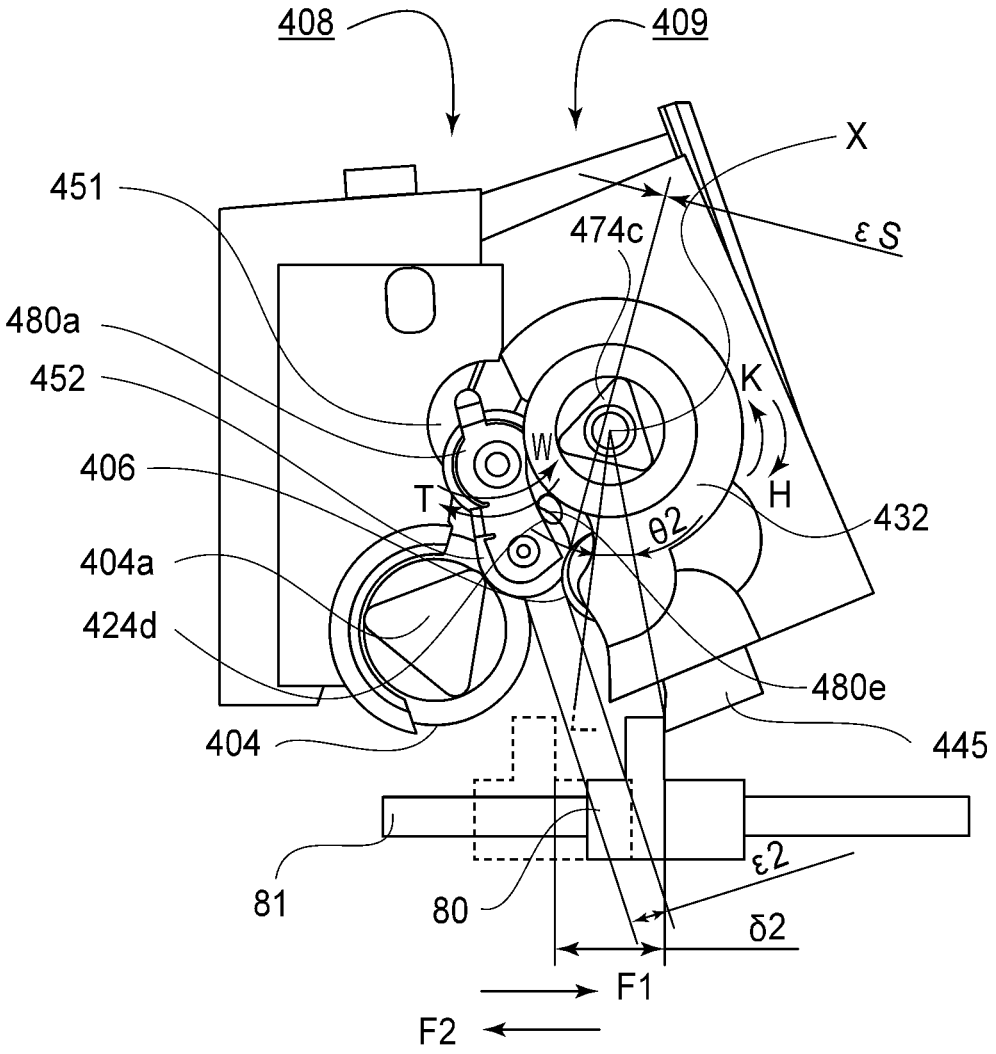

FIG. 17A is a side view of the process cartridge in the third embodiment of the present invention, when the development unit is in contact with the unit; FIG. 17B, when the development unit has separated from the unit, and the idler gear is in mesh with the development roller gear; and FIG. 17C is a side view of the process cartridge when the development unit has separated from the unit, and the idler gear has separated from the development roller gear.

Figure 18:
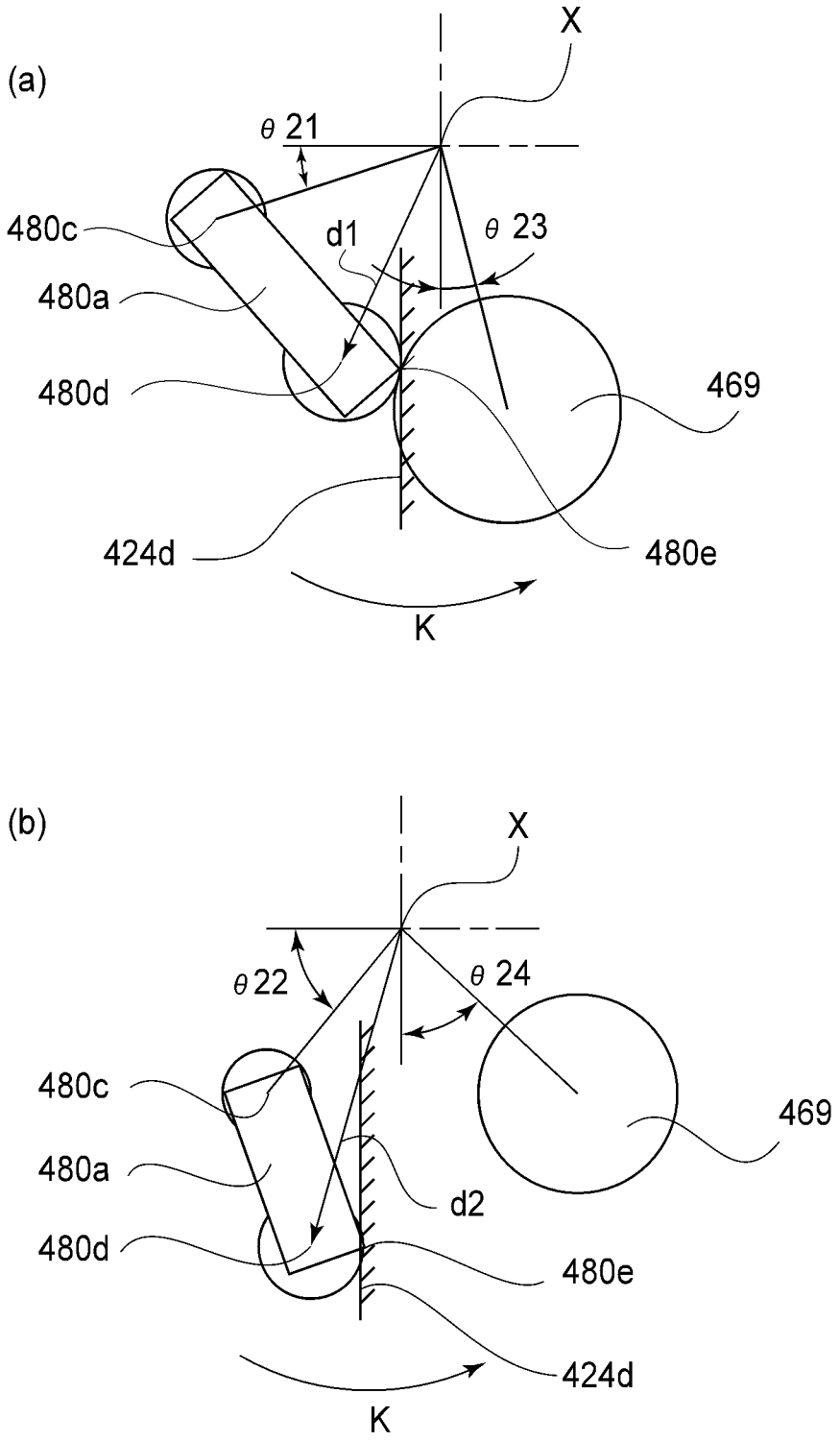

Parts (a) and (b) of FIG. 18 are schematic drawings of a combination of the connective member, guiding surface, and development roller gear of the cartridge, when the idler gear is in mesh with the development roller gear, and when the idler gear has just been separated from the development roller gear by the guiding surface, respectively.

Figure 19:
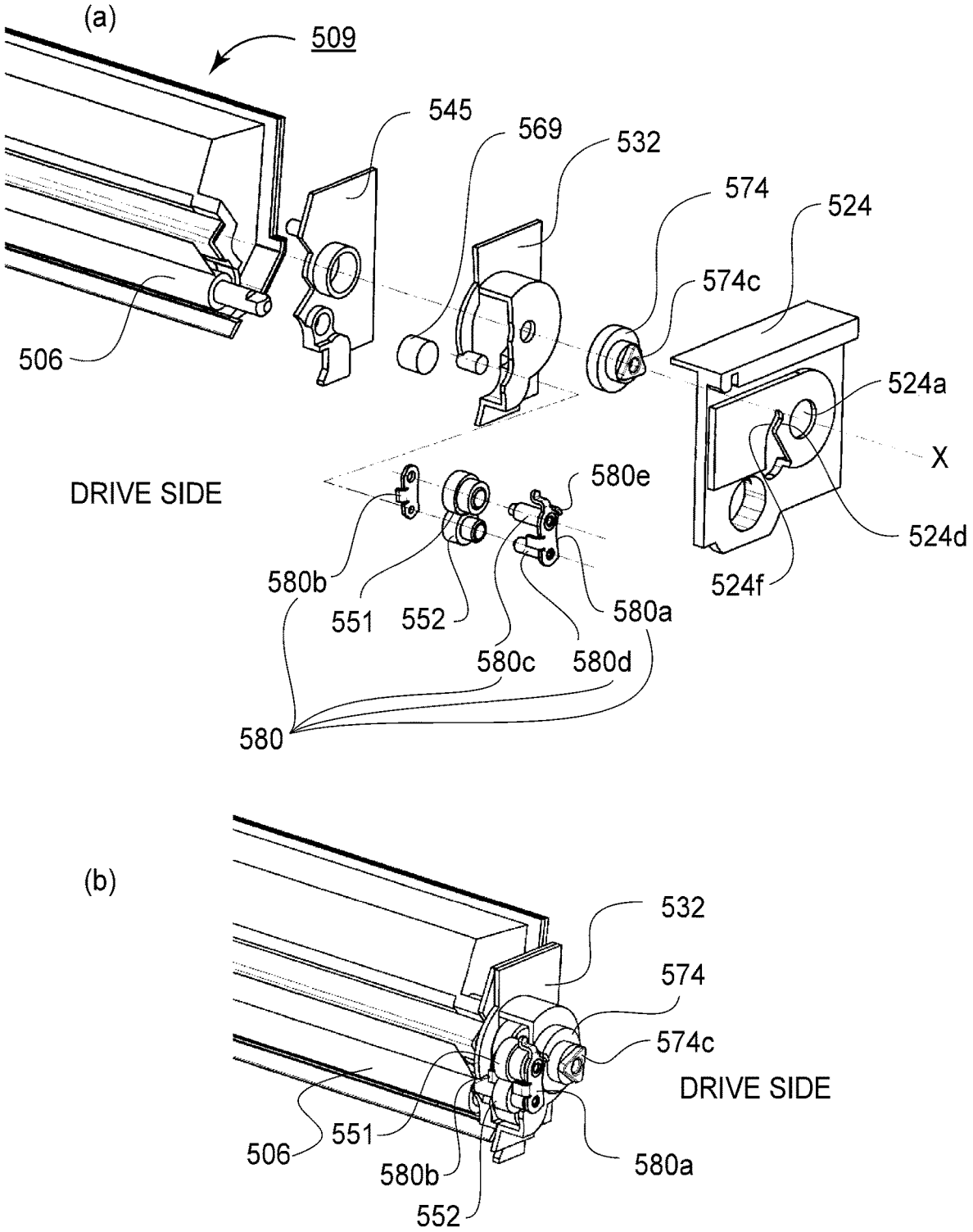

Parts (a) and (b) of FIG. 19 are perspective views of the process cartridge in the fourth embodiment of the present invention.

Figure 20A:
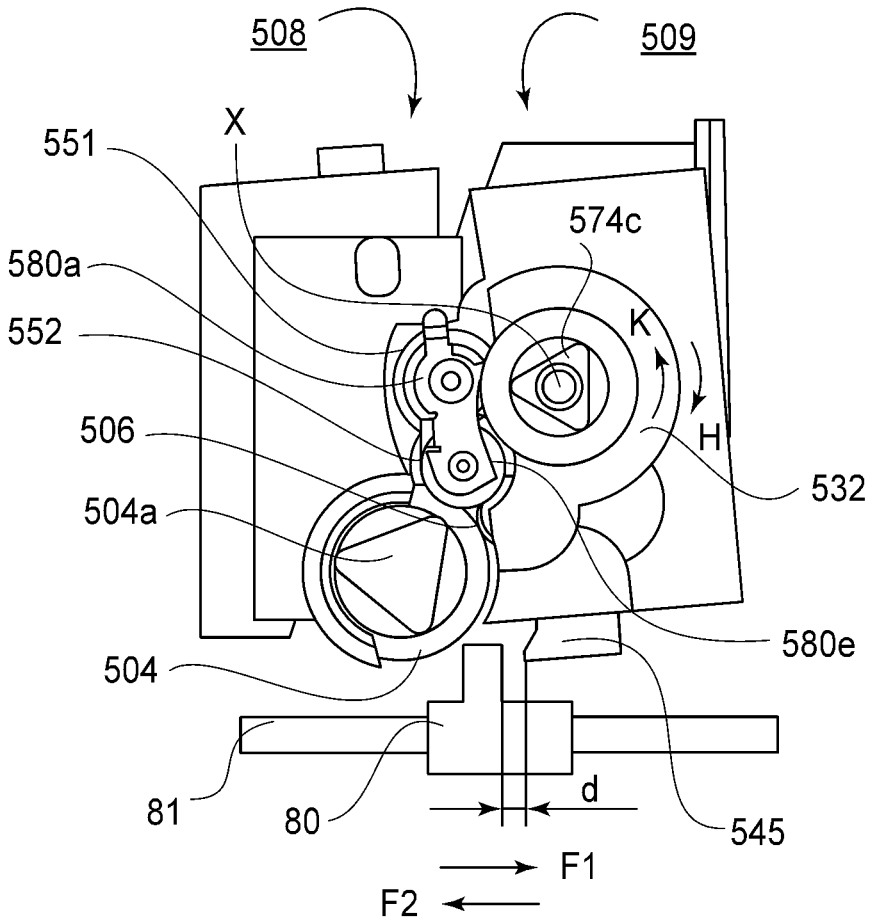
Figure 20B:
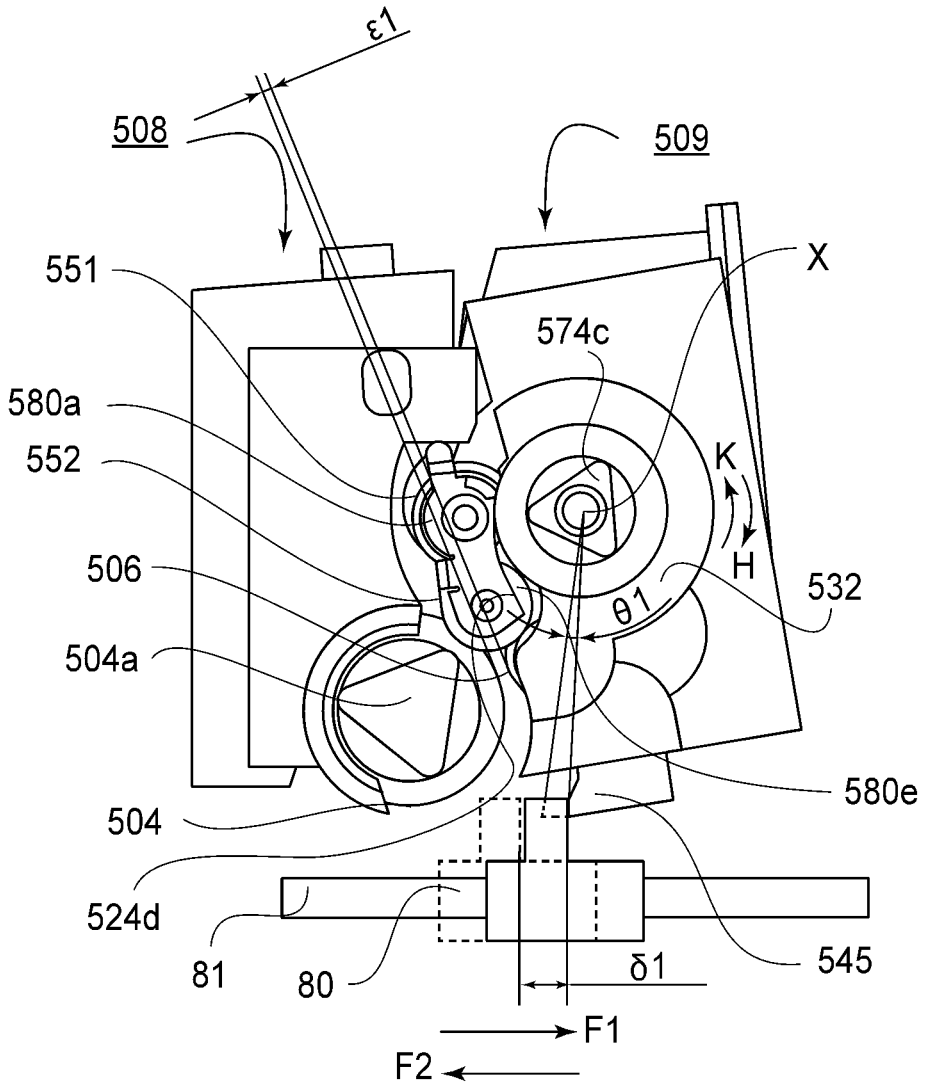
Figure 20C:
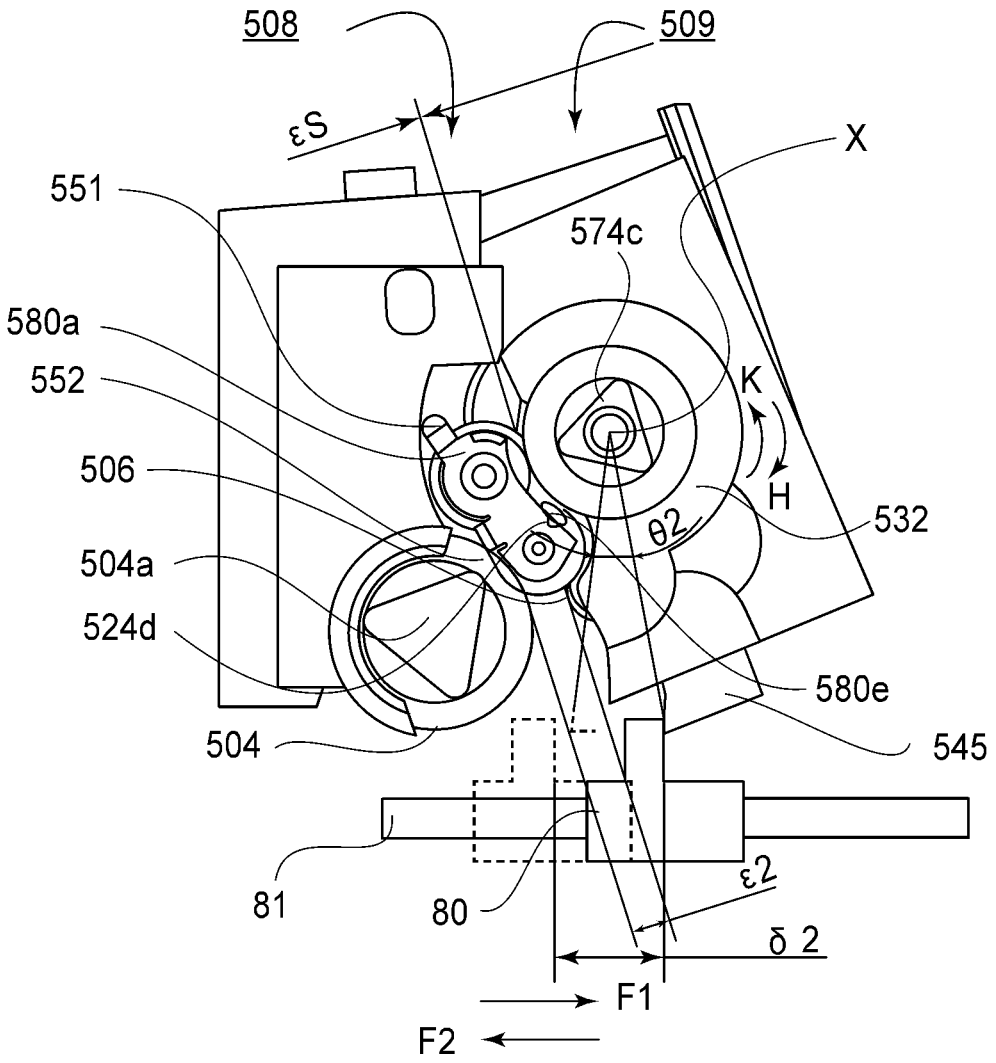

FIGS. 20A, 20B and 20C are side views of the process cartridge in the fourth embodiment, showing the states of the process cartridges when the development unit is in contact with the drum, when the development unit has just separated from the drum, and the idler gear and development coupling gear are in mesh with each other, and when the development unit has just separated from the drum, and the idler gear and development coupling gear have just separated from each other.

Figure 21:
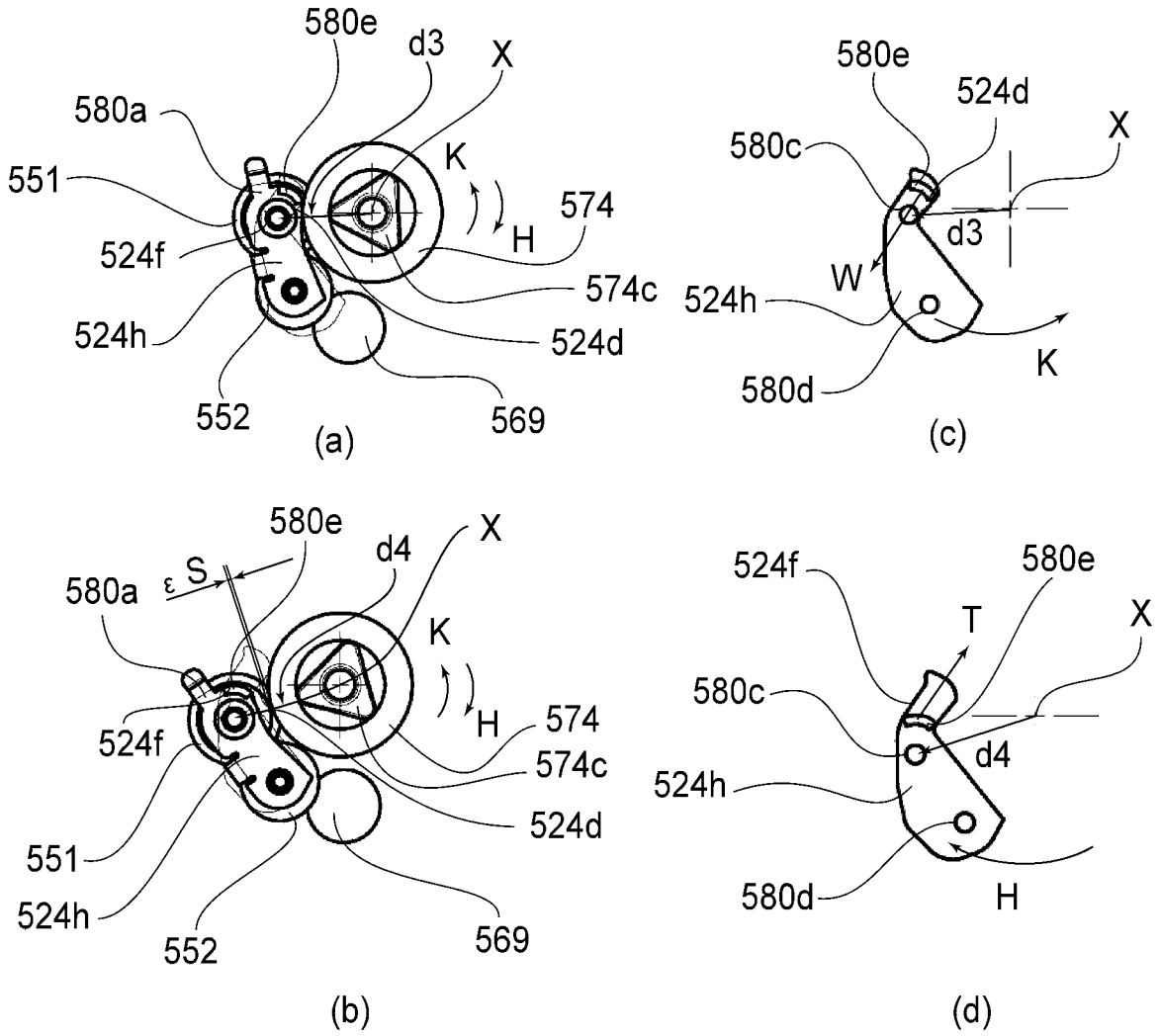

Parts (a), (b), (c) and (d) of FIG. 21 are views of a combination of the pivotally movable gears and guiding surface in the forth embodiment, in which parts (a) and (b) of FIG. 21 shows the state of the combination when the idler gear and development coupling gear are in mesh with each other, and when the idler gear has just been separated from the development coupling gear by the guiding surface, respectively, part (c) and (d) of FIG. 21 shows a combination of the guiding surface, and the portion to be guided by the guiding surface, when the idler gear and development coupling gear are in mesh with each other, and when the idler gear has just been separated from the development coupling gear by the guiding surface, respectively.

Figure 22:
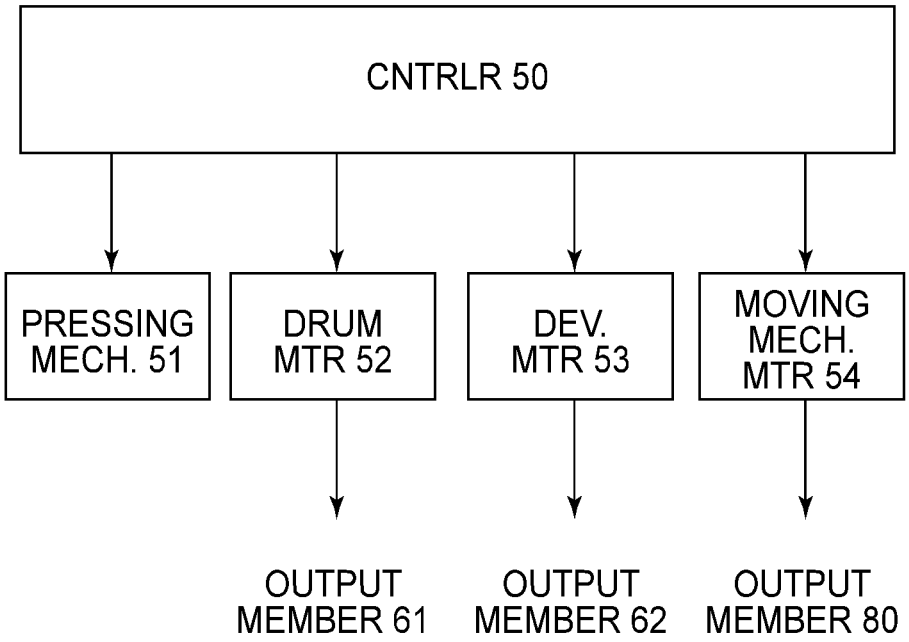

FIG. 22 is a block diagram of a system for controlling the driving force transmission, which is in accordance with the present invention.

DESCRIPTION OF THE EMBODIMENTS

Embodiment 1

[General Description of Structure of Electrophotographic Image Forming Apparatus]

To begin with, the first embodiment of the present invention is described with reference to appended drawings. By the way, each of the image forming apparatuses in the following embodiments of the present invention is a full-color image forming apparatus which employs four process cartridges which are removably installable in the main assembly of the apparatus. However, these embodiments are not intended to limit the present invention in scope in terms of the number of process cartridges which an image forming apparatus requires for image formation. That is, the number is set as necessary. For example, in a case of an image forming apparatus for forming a monochromatic image, the number of process cartridge to be installed in the image forming apparatus is one. Further, in each of the embodiments of the present invention which are described hereafter, the image forming apparatus forming apparatus is a printer.

[General Structure of Image Forming Apparatus]

Figure 2:
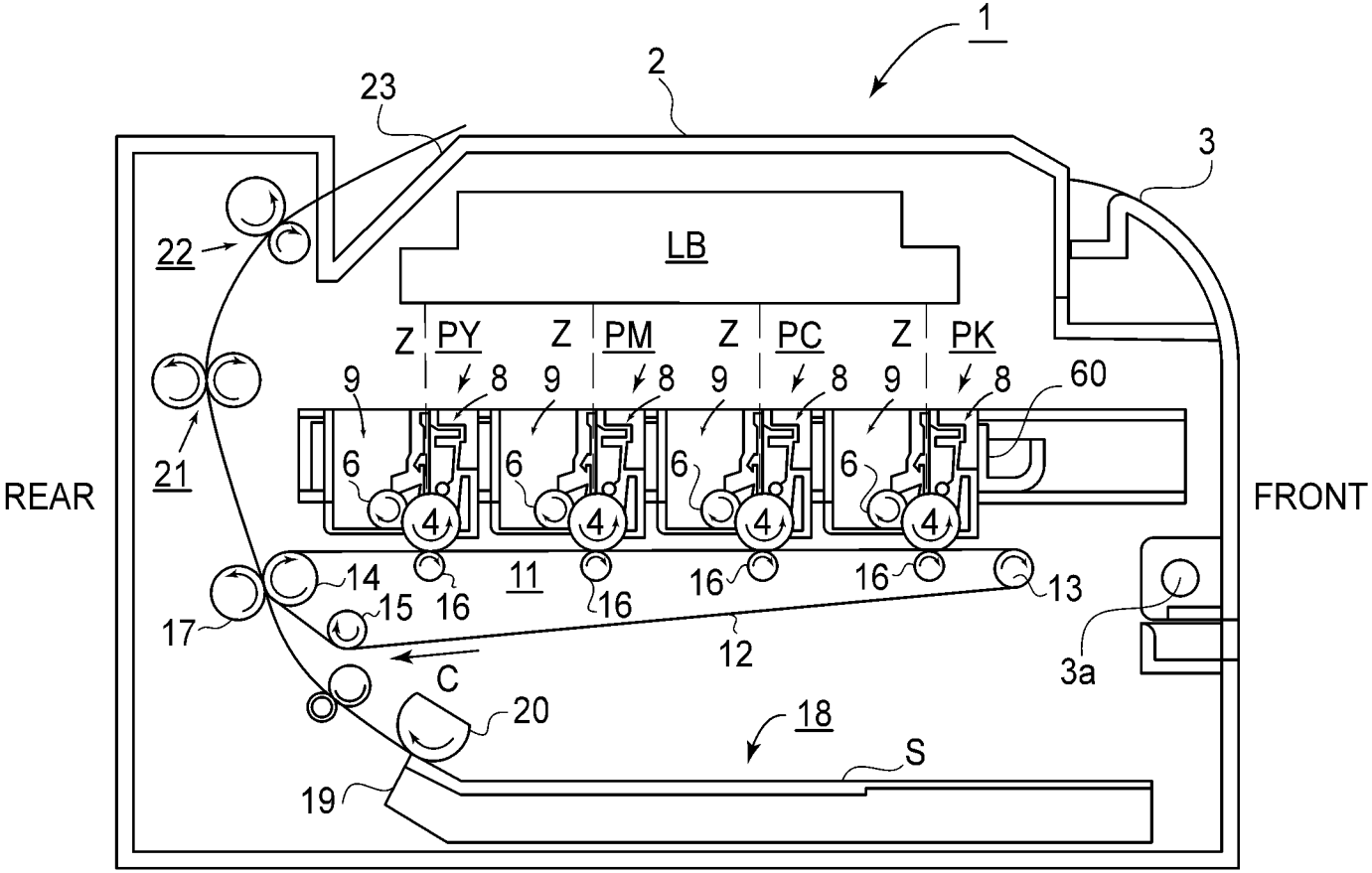
FIG. 2 is a sectional view of the image forming apparatus in the first embodiment.

FIG. 2 is a schematic sectional view of the image forming apparatus 1 in this embodiment. Part (a) of FIG. 3 is a perspective view of this image forming apparatus 1, when the cartridge tray 60 of the apparatus, in which four process cartridges P (PY, PM, PC, PK) are installable, is in its outermost position, into which the tray 60 has just been moved from its innermost position in the main assembly 2 (which hereafter will be referred to as apparatus main assembly) of the image forming apparatus 1. Part (b) of FIG. 3 is a perspective view of the essential portions of the apparatus main assembly 2. FIG. 4 is a sectional view of one of the process cartridges P in this embodiment. FIG. 5 is a exploded perspective view of the process cartridge P in this embodiment, as the process cartridge P is seen from the side from which it is driven (which hereafter may be referred to as driven side). FIG. 6 is an exploded perspective view of the process cartridge P as it is seen from the side from which it is not driven (which hereafter may be referred to as non-driven side).

Referring to FIG. 2, this image forming apparatus 1 is a full-color laser printer. It uses an electrophotographic image forming process based on four primary colors. It forms a color image on a sheet S of recording medium. It is of the so-called process cartridge type. More specifically, it employs four process cartridges, that is, the first to fourth process cartridges P (PY, PM, PC and PK) which are removably installable in the apparatus main assembly 2, to form a color image on the sheet S. The apparatus main assembly 2 is what will be left behind as the process cartridges P are removed from the image forming apparatus 1. A sheet S is a sheet of recording medium on which a toner image can be formed.

Regarding the positioning of the image forming apparatus 1, the side of the image forming apparatus 1, which has a door 3 (front door) is referred to as the front side (front surface). The opposite side from the front side (front surface) is referred to as the rear side (rear surface). Further, the right side of the image forming apparatus 1 as the image forming apparatus 1 is seen from the front side, is referred to as the driven side, whereas the left side of the image forming apparatus 1 is referred to as non-driven side. FIG. 2 is a sectional view of the image forming apparatus 1 as seen from the non-driven side. That is, the right side of the drawing (FIG. 2) coincides with the front side of the image forming apparatus 1; the front side of the drawing, non-driven side of the image forming apparatus 1; and the rear side of the drawing coincides with the driven side of the image forming apparatus 1.

The four process cartridges, that is, the first to fourth process cartridges P (which hereafter will be referred to simply as cartridges) are horizontally aligned in tandem in the apparatus main assembly 2 in the listed order, in the rear to front direction of the apparatus main assembly 2, being held in their designated positions, one for one. The designated position for a cartridge P means a position in the apparatus main assembly 2, in which a cartridge P is enabled to perform an image forming operation.

Four cartridges P are the same in structure, and each of them can carry out an electrophotographic image formation process. However, they are different in the color of developer (toner) stored therein. To each cartridge P, rotational driving force is transmitted from the driving force outputting portions 61 and 62 of the apparatus main assembly 2. The details of this driving force transmission will be given later. Further, to each cartridge P, bias voltage (charge bias, development bias, etc.,) is supplied from the apparatus main assembly 2 (structure of bias application means is not shown).

Referring to FIG. 4, each cartridge P has: an electrophotographic photosensitive member 4, as an image bearing member, which is in the form of a drum (which hereafter will be referred to simply as drum); and a drum unit 8 having processing means, more specifically, a charging means 5 and cleaning means 7, which are for processing the drum 4. Further, each cartridge P has a development unit 9 having a developing means 6 for developing an electrostatic latent image on the drum 4.

The first cartridge PY holds yellow (Y) toner in its frame 29. It forms a yellow image on the peripheral surface of the drum 4, of the yellow developer. The second cartridge PM holds magenta (M) developer in its frame 29. It forms a magenta image on the peripheral surface of its drum 4, on the magenta developer. The third cartridge PC holds cyan (C) developer in its frame 29. It forms a cyan image on the peripheral surface of its drum 4, of the cyan developer. The fourth cartridge PK holds black (K) developer in its frame 29. It forms a black image on the peripheral surface of its drum 4, of the black toner.

The apparatus main assembly 2 is provided with a laser scanner unit LB, as an exposing means, which is positioned above the combination of four cartridges P. This laser scanner unit LB outputs a beam Z of laser light while modulating the beam Z according to the information about the image to be formed, in such a manner that the beam Z scans the peripheral surface of the drum 4 through the exposure window 10 of the cartridge P. There is provided below the each cartridge P, an intermediary transfer belt unit 11 as a transferring member. This intermediary transferring unit 11 has a driving roller 13, a belt-backing roller 14, a tension roller 15, and a flexible transfer belt 12. The transfer belt 12 is supported by these rollers 13, 14 and 15 in such a manner that the belt bridges between the adjacent two of these three rollers 13, 14 and 15.

The drum 4 of each cartridge P is in contact with the outwardly facing surface of the transfer belt 12, by its downwardly facing portion of its peripheral surface. The interface between the drum 4 and transfer belt 12 is the primary transferring portion. On the inward side of the loop (belt loop) which the transfer belt 12 forms, a primary transfer roller 16 is disposed in a manner to oppose the drum 4. Also on the inward side of the belt loop, a secondary transfer roller 17 is disposed in a manner to oppose the belt-backing roller 14, with the presence of the transfer belt 12 between itself and the belt-backing roller 14. The interface between the transfer belt 12 and secondary transfer roller 17 is the secondary transferring portion.

There is disposed a sheet feeding unit 18 below the intermediary transfer belt unit 11. The sheet feeding unit 18 has a tray 19 in which a substantial number of sheets S of recording medium can be stored in layers, and a sheet feeding roller 20. Further, the apparatus main assembly 2 is provided with a fixation unit 21 and a discharge unit 22, which are disposed in the top portion of the rear side of the internal space of the apparatus main assembly 2. A part of the top wall of the frame of the apparatus main assembly 2 is utilized as a delivery tray 23.

[Structural Arrangement for Installing or Uninstalling Cartridges]

When the first to fourth cartridges P are in the apparatus main assembly 2, they are supported by the cartridge tray 60. The image forming apparatus 1 is structured so that as this cartridge tray 60 is pulled out of the apparatus main assembly 2 through the front opening of the apparatus main assembly 2 as shown in part (a) of FIG. 3, the cartridges P can be placed into, or removed from, the cartridge tray 60.

That is, the apparatus main assembly 2 is structured so that the front door 3 can be pivotally moved about the axial line of the hinge portion 3*a* of the door 3, from its closed position to its open position shown in part (a) of FIG. 3, to fully expose the front opening of the apparatus main assembly 2. A user is to pull the cartridge tray 60 which is in its designated inward position in the apparatus main assembly 2, out of the apparatus main assembly 2 through the front opening, into the designated outward position for the cartridge tray 60 as shown in part (a) of FIG. 3. After the cartridge tray 60 is pulled out of the apparatus main assembly 2, into its designated outward position, each cartridge P in the cartridge tray 60 can be pulled out of the cartridge tray 60, and/or replaced with a new one.

After a relevant cartridges P (cartridge P) in the cartridge tray 60 is replaced with a brand new one, the cartridge tray 60 is to be pushed back into its designated inward position in the apparatus main assembly 2, from the outward position, and the front door 3 is to be pivotally moved back into its closed position from its open position, by the user, so that each cartridge P is placed in its designated position in the apparatus main assembly 2, to put the image forming apparatus 1 in the state in which the apparatus can perform an image forming operation.

[Image Forming Operation]

The operation which is to be carried out by the image forming apparatus 1 to form a full-color image is as follows: The drum 4 in each of the first to fourth cartridges P is rotationally driven at a preset speed (in direction indicated by arrow mark D in FIG. 4; counterclockwise direction in FIG. 2). Further, transfer belt 12 is rotationally driven in such a direction (indicated by arrow mark C in FIG. 2) that in the interface between the drum 4 and belt 12, the peripheral surface of the drum 4 and belt 12 move in the same direction, at a speed which corresponds to that of the peripheral surface of the drum 4. Further, the laser scanner unit LB also is driven.

In synchronism with the driving of the scanner unit LB, the peripheral surface of the drum 4 is uniformly charged to preset polarity and potential level by the charge roller 6 as a charging means. The laser scanner unit LB scans (exposes) the charged portion of the peripheral surface of the drum 4, with a beam Z of laser light which its outputs while modulating the beam Z with the image formation signals which correspond to the color components (Y, M, C and K) of the image to be formed. As a result, an electrostatic latent image which corresponds to the image formation signals, is formed on the peripheral surface of each drum 4. This electrostatic latent image is developed by the development roller 6, as a developing means, which is being rotationally driven in contact with the peripheral surface of the drum 4 (contact development) at a preset speed (in direction indicated by arrow mark E in FIG. 4; clockwise direction in FIG. 2).

Through the electrophotographic image formation process described above, a yellow image (visible image), which corresponds to the yellow component of the full-color image to be formed, is formed on the peripheral surface of the drum 4 of the first cartridge PY. Then, this visible image formed of the yellow developer (which hereafter will be referred to as yellow developer image) is transferred (primary transfer) onto the transfer belt 12. Similarly, a magenta (M) developer image, which corresponds to the magenta (M) component of the full-color image is formed on the peripheral surface of the drum 4 of the second cartridge PM. This developer image is transferred (primary transfer) onto the transfer belt 12 in such a manner that it overlaps with the yellow developer on the transfer belt 12, which has just been transferred onto the transfer belt 12.

Similarly, a cyan (C) developer image which corresponds to the cyan component of the full-color image is formed on the peripheral surface of the drum 4 of the third cartridge PC. Then, this developer image is transferred (primary transfer) onto the transfer belt 12, in such a manner that it overlaps with a combination of the yellow (Y) and magenta (M) developer images, which have just been transferred onto the transfer belt 12. Similarly, the black (K) developer image which corresponds to the black (K) component of the full-color image is formed on the peripheral surface of the drum 4 of the fourth cartridge P. Then, this developer image is transferred (primary transfer) onto the transfer belt 12 in such a manner that it overlaps with a combination of yellow (Y), magenta (M), and cyan (c) images, which have just been transferred onto the transfer belt 12.

Through the processes described above, an unfixed full-color developer image is formed on the transfer belt 12, of the yellow (Y), magenta (M), cyan (c) and black (K) developers (toners). Meanwhile, the sheets S of recording medium are fed one by one into the apparatus main assembly 2 from the sheet feeding unit 18 while being separated from the rest, with preset timing. Then, each sheet S of recording medium is introduced into the secondary transferring portion with preset timing, and is conveyed through the secondary transferring portion. While the sheet S is conveyed through the secondary transferring portion, the four unfixed monochromatic developer images layered on the transfer belt 12 are transferred together onto the sheet S, in the secondary transferring portion. After the transfer of the unfixed multicolor developer image onto the sheet S, the developer images are fixed to the sheet S by a fixing means with which the fixation unit 21 is provided. Then, the sheet S is discharged as a color print, into the delivery tray 3.

[Overall Structure of Process Cartridge]

As described above, each cartridge P has a system for carrying out an electrophotographic image formation process. The color of the developer to be stored in each cartridge P, and the amount by which developer is to be stored in each cartridge P, are optional. Further, each cartridge P is provided with the drum 4 as an image bearing member, and processing means for processing the drum 4. The processing means are the charge roller 5 as the charging means for charging the drum 4, development roller 6 as the developing means to be placed in contact with the drum 4 to develop a latent image formed on the drum 4, cleaning blade 7 as a cleaning means for removing the residual developer on the peripheral surface of the drum 4, etc. Further, each cartridge P is made up of a drum unit 8 and a development unit 9.

[Structure of Drum Unit]

Referring to FIGS. 4-6, the drum unit 8 is made up of the drum 4 as a photosensitive member, charge roller 5, cleaning blade 7, cleaning means container 26 as the frame of the drum unit 8, waste developer storing portion 27, and supporting members 24 and 25 as members for movably supporting the development unit frame 29. The development unit frame 29 is the frame of the development unit 9 which will be described later. The supporting member 24 (which hereafter will be referred to as cartridge covering member) is the first supporting member which is on the driven side. The supporting member 25 (which hereafter will also be referred to as cartridge covering member) is the second supporting member, which is on the non-driven side.

As broad interpretation of word, the photosensitive member frame includes waste developer storing portion 27, cartridge covering member 24 on the driven side, cartridge covering member on the non-driven side, in addition to the container 26 as the photosensitive member frame in terms of more strict definition of word (this definition applies to second to fourth embodiments which will be described later).

As the cartridge P is installed into the apparatus main assembly 2, the positioning portion of the photosensitive member frame 26 is pressed on the positioning portion of the apparatus main assembly 2 which is under the control of the controlling portion 50 (FIG. 2), by the pressing action of the pressing mechanism 51 of the apparatus main assembly 2. Consequently, the drum unit 8 of the cartridge P is fixed in position relative to the apparatus main assembly 2. A concrete illustration of the pressing mechanism 50 is not given here.

The drum 4 is rotatably supported by the cartridge covering members 24 and 25 with which the lengthwise ends, that is, driven and non-driven ends, of the cartridge P, are provided, respectively. Here, the direction which is parallel to the axial line of the drum 4 is defined as the lengthwise direction. The cartridge covering members 24 and 25 are fixed to the cleaning container 26, at the lengthwise ends of the cleaning container 26, one for one. Next, referring to FIG. 5, one of the lengthwise ends of the drum 4 (driven end) is provided with a coupling member 4*a* as a driving force input portion for transmitting driving force to the drum 4.

Part (b) of FIG. 3, is a perspective view of the essential portion of the apparatus main assembly 2. However, the front door 3, cartridges P, cartridge tray 60 which supports the cartridges P, intermediary transfer belt unit 11, sheet feeding unit 18, etc., are not shown in part (b) of FIG. 3. As a cartridge P is installed into the apparatus main assembly 2, the coupling member 4*a* of the cartridge P engages with a drum driving force outputting member 61 (61Y, 61M, 61C or 61K) of the apparatus main assembly 2 as the driving force transmitting portion of the apparatus main assembly 2. The drum driving force transmitting member 61 is driven by a drum driving motor 52, which is under the control of the controlling portion 50 (FIG. 22). The driving force from this drum driving force outputting portion 61 is transmitted to the drum 4.

The charge roller 5 is supported by the cleaning container 26 in such a manner that it is rotated by the rotation of the drum 4 by being in contact with the drum 4. The cleaning blade 7 is supported by the cleaning container 26 in such a manner that it is kept in contact with the peripheral surface of the drum 4 by a preset amount of pressure. As the transfer residual developer is removed from the peripheral surface of the drum 4 by the cleaning blade 7, it is stored in the waste developer storing portion 27 in the cleaning container 26.

The cartridge covering member 24 on the driven side, and the cartridge covering member 25 on the non-driven side, are provided with supporting portions 24*a* and 25*a*, respectively, which support the development unit 9 (FIGS. 5 and 6) so that the development unit 9 is allowed to pivotally move.

[Structure of Development Unit]

Referring to FIGS. 1A, 1B and 4-6, the development unit 9 is made up of the development roller 6, development blade 31, development frame 29, bearing member 45, driving force transmitting mechanism which includes a development coupling gear 74, development covering member 32, etc. The driving force transmitting mechanism, which will be described later in detail, is a mechanism for transmitting driving force from the driving force inputting portion for receiving driving force from the apparatus main assembly 2, to the development roller 6. The development frame 29 has: a developer storing portion 49 for storing the developer which is to be supplied to the development roller 6; and the development blade 31 for regulating in thickness the developer layer on the peripheral surface of the development roller 6.

Referring to FIG. 1, the bearing member 45 is fixed to one (driven side) of the lengthwise ends of the development frame 29. This bearing member 45 rotatably supports the development roller 6. The development roller 6 has a development roller gear 69 (development gear) attached to one of its lengthwise ends (driven side).

The development coupling gear 74 has the first driving force transmission gear 74*a* (which hereafter will be referred to as development coupling outward gear), and the second driving force transmission gear 74*b* (which hereafter will be referred to as development coupling inward gear). The development coupling outward gear 74*a* has a driving force inputting portion 74*c* (which hereafter will be referred to as driving force transmitting portion) as a rotational force receiving portion. The development coupling inward gear 74*b* is a gear for transmitting the driving force to the development roller gear 69. The bearing member 45 rotatably supports the development coupling inward gear 74*b*. The details of this structural arrangement will be given later.

Referring to FIG. 1, the development covering member 32 which is fixed to the outward side of the bearing member 45, in terms of the lengthwise direction of the cartridge P, is provided with a cylindrical portion 32*b*. It is inside this cylindrical portion 32*b* that the development coupling gear 74 is positioned. Further, the driving force transmitting portion 74*c* of the development coupling outward gear 74*a* is outwardly protrusive from the cylindrical portion 32*b* through the opening 32*d*.

As each cartridge P is installed into the apparatus main assembly 2, its driving force transmitting portion 74*c* engages with the development driving force outputting member 62 (62Y, 62M, 62C or 62K) shown in part (b) of FIG. 3. The development driving force outputting member 62 is driven by the development driving motor 53 which is controlled by the controlling portion 50 (FIG. 22). The driving force from this development driving force outputting member 62 is transmitted to the development coupling outward gear 74*a*.

As driving force is inputted into the development coupling outward gear 74*a* from the apparatus main assembly 2, it is transmitted to the development driving force transmitting gear 100 (pivotally movable gear, which hereafter will be referred to as development idler gear). Then, the driving force is transmitted from this development idler gear 100 to cleaning driving force transmission gears 101 and 102 (opposing gear, which hereafter will be referred to as cleaning idler gears). Then, the driving force is transmitted from the gear 101 to the gear 102, and then, from the gear 102 to the development roller gear 69, as the third driving force transmitting gear, and to the development roller 6, by way of the development coupling inward gear 74*b*.

[Assembling of Drum Unit and Development Unit]

FIGS. 5 and 6 show a combination of the disassembled development unit 9 and disassembled drum unit 8. One of the lengthwise ends of the cartridge P is fitted with the cartridge covering member 24 on the driven side in such a manner that the cylindrical portion 32*b* of the development covering member 32 is pivotally supported by the supporting portion 24*a* of the covering member 24. Further, at the other lengthwise end of the cartridge P, the protrusive portion 29*b* of the development frame 29 is pivotally fitted in the supporting hole 25*a* of the cartridge cover member 25 on the non-driven side.

Therefore, the development unit 9 is supported so that it is allowed to pivotally move (rotationally move) relative to the drum unit 8. Hereafter, the axis about which the development unit 9 pivotally moves will be referred to as a pivot X (rotational axis). This pivot X is a line which connects a center of the supporting portion 24*a* and the center of the supporting portion 25*a*.

[Contact Between Development Roller and Drum]

Referring to FIGS. 4, 5 and 6, each process cartridge P is structured so that the development unit 9 remains under the pressure generated by a pair of compression springs 95 which are elastic member as pressure applying members, in a direction to pivotally move the drum unit 8 about the pivot X to cause the development roller 6 to contact the drum 4. Here, the state of contact between the development roller 6 and drum 4 is such that the developer bearing surface of the development roller 6, that is, the peripheral surface of the development roller 6, contacts the drum 4 in such a manner that the latent image formed on the peripheral surface of the drum 4 is developed by the developer on the peripheral surface of the development roller 6.

As described above, the cartridge P is structured so that the development unit 9 is pressed by the force generated by the resiliency of the compression springs 95 which are elastic members as pressure applying members, in the direction indicated by an arrow mark G in FIG. 4, being thereby made to pivotally move about the pivot X in the direction indicated by an arrow mark H. That is, the cartridge P is structured so that the compression springs 95 generate such moment that causes the development unit 9 to pivotally move about the pivot X in a direction to cause the development roller 6 to contact the drum 4. Further, referring to FIGS. 5 and 6, the development coupling outward gear 74*a* receives from the development driving force outputting member 62, shown in part (b) of FIG. 3, which is the main assembly coupling with which the apparatus main assembly 2 is provided, such rotational driving force indicated by the arrow mark J. The driving force inputted into the development coupling outward gear 74*a* is received by the development coupling inward gear 74*b*, being thereby rotated in the same direction as the development coupling outward gear 74*a*, that is, the direction indicated by the arrow mark J. Therefore, the development roller gear 69 which is in engagement with the development coupling inward gear 74*b* rotates in the direction indicated by an arrow mark U (part (b) of FIG. 1), causing the development roller 6 to rotate in the direction indicated by an arrow mark E (FIG. 4).

As described above, as the driving force necessary to rotate the development roller 6 is inputted into the development coupling outward gear 74*a*, such moment that acts in the direction to pivotally move the development unit 9 in the direction indicated by the arrow mark H is generated in development unit 9. That is, a combination of the pressure from the compression springs 95 and the rotational driving force from the apparatus main assembly 2 generates such moment that causes the development unit 9 to pivotally move about the pivot X in the direction indicated by the arrow mark H. Therefore, the development roller 6 is placed in contact with the drum 4 by a preset amount of pressure. By the way, the position of the development unit 9 relative to the drum unit 8 while the development roller 6 is kept in contact with the drum 4 by the preset amount of pressure is referred to as contact position.

By the way, in this embodiment, the cartridge P is structured so that the combination of two forces, that is, the pressure from the compression springs 95 and the rotational driving force from the apparatus main assembly 2, is used to press the development roller 6 upon the drum 4. However, this embodiment is not intended to limit the present invention in scope in terms of the cartridge structure. For example, the cartridge P may be structured so that the development roller 6 is pressed upon the drum 4 by only one of the two forces described above.

[Separation of Development Roller from Drum]

FIGS. 7A, 7B and 7C are side views of the cartridge P, as seen from the driven side, after the installation the cartridge P into the apparatus main assembly 2. For descriptive convenience, some components of the cartridge P are unillustrated in FIGS. 7A, 7B and 7C. As described above, after the installation of the cartridge P into the apparatus main assembly 2, the drum unit 8 of the cartridge P remains fixed in the position to the apparatus main assembly 2.

The bearing member 45 of the development unit 9 is provided with a force receiving portion 45*a*. The cartridge P is structured so that the force receiving portion 45*a* is enabled to engage with a separating portion 80 with which the apparatus main assembly 2 is provided. Further, the cartridge P is structured so that this separating member 80 of the apparatus main assembly 2 catches the driving force from a separation system motor 54 which is under the control of the control portion 50 (FIG. 22), and moves in the direction indicated by an arrow mark F1 along a rail 81, or in the opposite direction indicated by an arrow mark F2.

FIG. 7A shows the state of the cartridge P when the development roller 6 is in contact with the drum 4. When the cartridge P is in this state, there is a distance d between the force receiving portion 45*a* and separating member 80. FIG. 7B shows the state of the cartridge P after the separating member 80 is moved from where it is in FIG. 7A, in the direction indicated by the arrow mark F1 by a distance δ1. When the cartridge P is in the state shown in FIG. 7B, the force receiving portion 45*a* is in engagement with the separating member 80 of the apparatus main assembly 2. As described above, the cartridge P is structured so that the development unit 9 is allowed to pivotally move relative to the drum unit 8. When the cartridge P is in the state shown in FIG. 7B, the development unit 9 has pivotally moved about the pivot X in the direction indicated by the arrow mark K by an angle θ1, and there is a distance ε1 between the drum 4 and development roller 6. FIG. 7C shows the state of the cartridge P after the separating member 80 has moved in the direction indicated by the arrow mark F1 by a distance δ2 (>δ1) from where it is in FIG. 7A. Further, the development unit 9 has pivotally moved about the pivot X in the direction indicated by the arrow mark K by an angle θ2 (>θ1). When the cartridge P is in the state shown in FIG. 7C, there is a distance ε2 (>ε1) between the drum 4 and development roller 6.

By the way, in this embodiment, the distance between the rotational axis of the force receiving portion 45*a* and that of the drum 4 is in a range of 13 mm-33 mm). Also in this embodiment, the distance between the force receiving portion 45*a* and pivot X is in a range of 27 mm-32 mm. The ranges of these distances are the same in the following embodiments (2-4).

On the other hand, as the separating member 80 is moved backward in the direction indicated by the arrow mark F2 from where it in of FIG. 7C, the development unit 9 pivotally moves backward about the pivot X in the direction indicated by the arrow mark H, to the position shown in FIG. 7B, and then, to the position, shown in FIG. 7A, in which the drum 4 is in contact with the development roller 6.

As described above, as the separating member 80 is controlled in its movement, the position of the development unit 9 relative to the drum unit 8 is controlled; the development unit 9 is moved into the "contact position" or "separation position". The contact position of the development unit 9 is such a position that the drum 4 is in contact with the development roller 6 as shown in FIG. 7A. The separation position of the development unit 9 is such a position that a certain amount of distance is present between the drum 4 and development roller 6 as shown in FIGS. 7B and 7C. The cartridge P is structured so that the development unit 9 is allowed to pivotally move about the pivot X to move between the contact position and separation position.

[Structure of Driving Force Transmitting Portion]

Figure 1A:
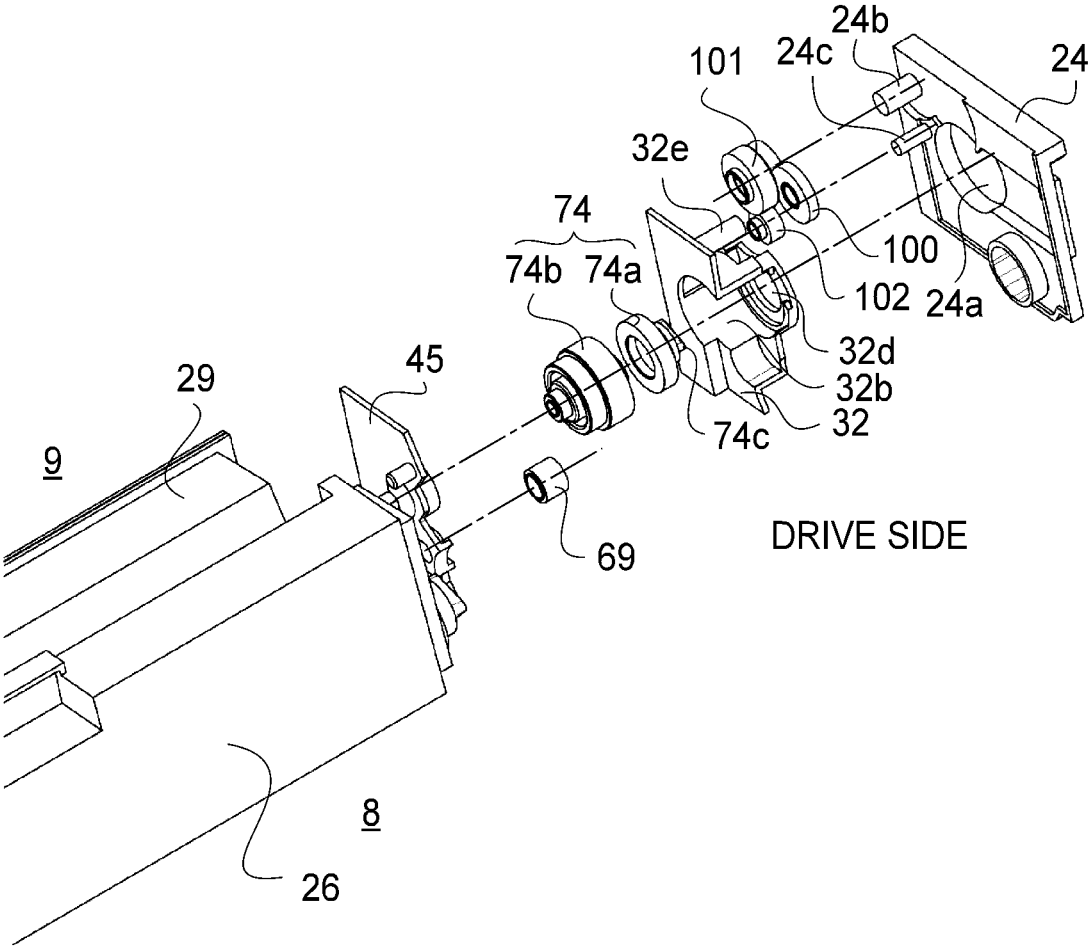
FIG. 1A is an exploded perspective view of the development unit in the first embodiment of the present invention.
Figure 1B:
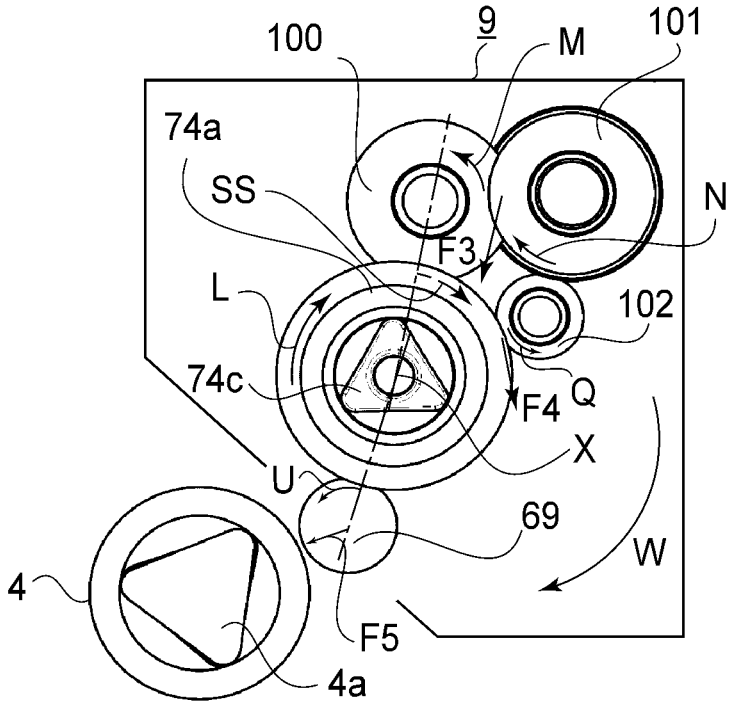
FIG. 1B is a sectional view of the development unit in the first embodiment when the development roller is in contact with the drum.

Referring to FIGS. 1A and 1B, the structure of the driving force transmitting portion (driving force transmitting mechanism) is concretely described. FIG. 1A is an exploded perspective view of the cartridge P. It shows the details of the positioning of the gears for transmitting driving force. FIG. 1B shows the positioning of the driving force transmission gears of the cartridge P when the cartridge P is in such a state that the development roller 6 is in contact with the drum 4.

As described above, the development unit 9 has the development coupling gear unit 74, development idler gear 100, and development roller gear 69. The development coupling gear unit 74 has the development coupling outward gear 74*a* (first gear portion), driving force transmitting portion 74*c* (driving force receiving portion), and development coupling inward gear 74*b* (second gear). As the cartridge P is installed into the apparatus main assembly 2, the driving force transmitting portion 74*c* engages with the development driving force outputting portion 62, shown in part (b) of FIG. 3, and receives the driving force from the development driving motor 53 (FIG. 22) which the apparatus main assembly 2 has.

The cartridge P is structured so that the development coupling outward gear 74*a* and driving force transmitting portion 74*c* pivotally move together about the pivot X. Further, it is structured so that the development coupling outward gear 74*a* which transmits the driving force to the development idler gear 100 (pivotal gear), and the development coupling inward gear 74*b*, are positioned to be allowed to pivotally move about the pivot X, independently from each other. That is, the cartridge P is structured so that the development coupling inward gear 74*b* is allowed to rotate about the pivot X, independently from the development coupling outward gear 74*a* and driving force transmitting portion 74*c*.

The development idler gear 100 is rotatably supported by a boss 32*e*, with which the development covering member 32 is provided, in such a manner that a preset amount of distance is maintained between itself and the development coupling outward gear 74*a*. It is meshes with the development coupling outward gear 74*a*. The development roller gear 69 is positioned so that a preset amount of distance is kept between itself and the development coupling inward gear 74*b*. It meshes with development coupling inward gear 74*b*.

The driven side cartridge covering member 24 of the drum unit 8 is provided with bosses 24*b* and 24*c*, by which the cleaning idler gear 101 (third gear) and cleaning idler gear 102 (fourth gear) are rotatably held, respectively, so that the two gears 101 and 102 mesh with each other. Further, when the distance between the axial line of the development idler gear 100 and that of the cleaning idler gear 101 is set so that when the development unit 9 is in contact with the drum 4, the development idler gear 100 is in mesh with the cleaning idler gear 101. Further, the cleaning idler gear 101 and cleaning idler gear 102 are positioned so that the distance between the axial line of the cleaning idler gear 101 and that of the cleaning idler gear 102 remains stable at a preset value, with the two gears 101 and 102 remaining in mesh with each other.

That is, the development idler gear 100, cleaning idler gear 101, and cleaning idler gear 102, which make up the idler gear train of the mechanism for transmitting driving fore to the development roller 6 belongs to the development unit 9, whereas the cleaning idler gear 101 and cleaning idler gear 102 belong to the drum unit 8.

Next, how the driving force is transmitted from the development driving force outputting member 62 (part (b) of FIG. 3) of the apparatus main assembly 2 to the development roller 6 during an image forming operation is described. The driving force from the development driving force outputting member 62 is received by the development coupling outward gear 74*a* through the driving force transmitting portion 74*c*, and then, is transmitted to the development idler gear 100. Then, it is transmitted from the development idler gear 100 to the cleaning idler gear 102 by way of the cleaning idler gear 101 of the drum unit 8.

Then, the driving force is transmitted from the cleaning idler gear 102 to the development roller gear 69 by way of the development coupling inward gear 74*b* of the development unit 9, and rotates the development roller 6. By this rotation of the development roller 6, the toner on the development roller 6 is supplied to the drum 4 to form an image on the drum 4.

Next, referring to FIGS. 7C and 8, how the driving force is transmitted to the development roller 6 when the development unit 9 is not in contact with the drum 4 is described. As described above, the development coupling outward gear 74*a* rotates about the pivot X of the development unit 9. As the development unit 9 separates from the development roller 6 as shown in FIG. 7C, the development idler gear 100 which has been in mesh with the development coupling outward gear 74*a* pivotally moves with the development unit 9, in the direction indicated by the arrow mark K about the pivot X by the angle θ2. However, even as the development unit 9 separates from the development roller 6, the cleaning idler gear 101 does not move because it is fixed to the drum unit 8.

That is, as the development unit 9 separates from the drum 4 by no less than a preset amount, the cleaning idler gear 101 fixed to the drum unit 8, and the development idler gear 100 fixed to the development unit 9, separate from the cleaning idler gear 101 by a distance ε3. That is, the development idler gear 100 (pivotally movable gear) and cleaning idler gear 101 (opposing gear) disengage from each other (state in which driving force cannot be transmitted).

Therefore, the driving force from the development coupling outward gear 74*a* is not transmitted to the cleaning idler gear 101. Therefore, the cleaning idler gear 101 and development coupling inward gear 74*b* also are not driven. Therefore, the development roller gear 69 does not rotate. Therefore, when the development unit 9 is separated from the drum 4 as shown in FIG. 7C, the driving force from the development coupling outward gear 74*a* is not transmitted to the development roller gear 69, that is, the development roller 6.

[Operation for Preventing Driving Force from being Transmitted to Development Roller]

Referring to FIGS. 1B and 7C, the operation for preventing the driving force from being transmitted to the development roller 6 is described. The structural arrangement for changing the cartridge P in state from the one in which the driving force is transmittable to the development roller gear 69 to rotate the development roller 6, to the one in which the driving force is not transmittable to the development roller gear 69 to rotate the development roller 6 is described next.

Referring to FIG. 1B, while the development roller 6 is driven, the development coupling outward gear 74*a* rotates about the pivot X in the direction indicated by an arrow mark L, and the development idler gear 100 of the development unit 9 rotates in the direction indicated by an arrow mark M. Thus, the driving force from the development idler gear 100 is transmitted from the development idler gear 100 to the cleaning idler gear 101 of the drum unit 8. Thus, the cleaning idler gear 101 rotates in the direction indicated by an arrow mark N.

Further, the driving force from the cleaning idler gear 101 is transmitted to the cleaning idler gear 102, causing the cleaning idler gear 101 to rotate in the direction indicated by an arrow mark Q. Moreover, the driving force from the cleaning idler gear 102 is transmitted to the development coupling inward gear 74*b*, causing the gear 74*b* to rotate in the direction indicated by an arrow mark S1. Further, the driving force from the development coupling inward gear 74*b* rotates the development roller gear 69 in the direction indicated by an arrow mark U, causing the development roller 6 to rotate.

That is, it is when the development idler gear 100 of the development unit 9 is in mesh with the cleaning idler gear 101 of the drum unit 8 that the driving force is transmitted to the development roller 6.

Next, as the force receiving portion 45*a* of the bearing member 45 which was in the state shown in FIG. 7A is moved in the direction F1 by the distance δ2 as shown in FIG. 7C, the development unit 9 pivotally moves about the pivot X by the angle θ2 in the separation direction indicated by the arrow mark K. As a result, the development idler gear 100 of the development unit 9 also pivotally moves in the direction indicated by the arrow mark K by the angle θ2, while keeping a preset amount of distance from the rotational axis of the development coupling gear 74, as shown in FIG. 8. Consequently, the tip of the tooth of the cleaning idler gear 101 of the drum unit 8 separates from the tip of the corresponding tooth of the development idler gear 100, stopping thereby the transmission of the driving force to the cleaning idler gear 101.

That is, the drive train through which the driving force transmitting portion 74*c* transmits the driving force, which it received from the apparatus main assembly 2, to the development roller 6 has the following sections. The first section has: the development coupling outward gear 74*a*, development coupling inward gear 74*b*, development idler gear 100, and development roller gear 69. It is the first driving portion, which receives the driving force from the driving force transmitting portion 74*c* by engaging with the driving force transmitting portion 74*c*. The second section has the cleaning idler gear 101 and cleaning idler gear 102, and transmits the driving force to the development roller 6. When the development unit 9 is in its contact position, the first and second driving sections are in connection to each other in such a manner that the driving force is transmitted from the first driving section to the second driving section. When the development unit 9 is in the separation position, the first and second driving section are not in connection to each other, preventing thereby the driving force from being transmitted from the first driving section to the second driving portion.

[Driving Force Transmission Starting Timing and Development Roller Contact Timing]

Next, referring to FIG. 9, the relationship between the timing with which the driving force transmission is started and the timing with which the development roller 6 is placed in contact with the drum 4 is described. In order for the image forming apparatus 1 to be enabled to output images which are as uniform as possible during an image forming operation, it is necessary for the toner layer coated on the peripheral surface of the development roller 6 to be uniform in thickness. However, if an image forming operation is started immediately after the development roller 6 is placed in contact with the drum 4, it is possible that the image forming apparatus 1 will output images which are not uniform, because immediately after the image forming apparatus 1 begins to be driven, the toner layer on the development roller 6 is nonuniform in thickness. Thus, in order to make the toner layer on the development roller 6 uniform in thickness, the development roller 6 may be rotated for a preset length of time before the development roller 6 is placed in contact with the drum 4. Next, the structural arrangement for allowing the development roller 6 to rotate for a preset length of time before it is placed in contact with the drum 4 is described.

FIG. 9 shows the state of meshing between the development idler gear 100 and cleaning idler gear 101. In this embodiment, the development idler gear 100 and cleaning idler gear 101 are provided with relatively tall (long) teeth. However, the cartridge P may be designed so that only one of the two gears 100 and 101 is provided with tall (long) teeth.

Part (a) of FIG. 9 corresponds to FIG. 7C in that both show the state of the cartridge P, in which the development roller 6 is not in contact with the drum 4, and the development idler gear 100 is not in mesh with the cleaning idler gear 101, preventing therefore the driving force from being transmitted to the development roller 6.

Part (b) of FIG. 9 corresponds to FIG. 7B in that the cartridge P is in such a state that there is a small distance between the drum 4 and development roller 6, and one of the teeth of the development idler gear 100 is in contact with the corresponding tooth of the cleaning idler gear 101 by a length x1 of 0.2 mm.

Part (c) of FIG. 9 corresponds to FIG. 7A in that drum 4 is in contact with the development roller 6, and the development idler gear 100 and cleaning idler gear 101 are fully in mesh with each other.

When the development idler gear 100 of the development unit 9 is not in mesh with the cleaning idler gear 102 of the development unit 9, the development idler gear 100 rotates in the direction indicated by the arrow mark M. However, the development idler gear 100 is not in mesh with the cleaning idler gear 101, and therefore, the cleaning idler gear 101 does not rotate. That is, the driving force is not transmitted to the development roller 6.

As the development roller 6 moves close to the drum 4 when it is in the position shown in part (a) of FIG. 9, that is, when it is not in contact with the drum 4, one 100*a* of the tall (long) teeth of the development idler gear 100 comes into contact with the corresponding tall (long) gear 101*a* of the cleaning idler gear 101 at a point V as shown in part (b) of FIG. 9. However, at this point in time, the development roller 6 is not in contact with the drum 4. It is when the teeth of both gears 100 and 101 become taller (longer) than a distance M (FIG. 7B) between the drum 4 and development roller 6 that the driving force begins to be transmitted.

That is, the driving force begins to be transmitted to the development roller 6 before the development roller 6 comes into contact with the drum 4 (FIG. 7A). Therefore, the toner layer on the development roller 6 is made more uniform in thickness.

Even in a case where the teeth of the development idler gear 100 and cleaning idler gear 101 are ordinary in terms of their height (length), effects similar to the above described one can be obtained by slowly moving the development roller 6 to place the development roller 6 in contact with the drum 4. Such an arrangement, however, delays the image formation timing, and therefore, reduces the image forming apparatus 1 in printing speed.

In comparison, this embodiment makes it possible to output undisturbed images without reducing the image forming apparatus 1 in image outputting speed. Incidentally, it has been experimentally confirmed that as long as the length x1 by which one of the tall (long) teeth 100*a* of the development idler gear 100 and the corresponding tall (long) gear 101*a* of the cleaning idler gear 101 contact with each other is no less than 0.2 mm, the driving force can be transmitted from the tooth 100*a* to the tooth 101*a*.

When the cartridge P is in the state in which the development roller 6 is in contact with the drum 4, the development idler gear 100 is fully in mesh with the cleaning idler gear 101 as shown in part (c) of FIG. 9. Therefore, the development idler gear 100 rotates in the direction indicated by the arrow mark M, and the cleaning idler gear 101 rotates in the direction indicated by the arrow mark N. That is, the driving force is transmitted to the development roller 6.

As described above, in this embodiment, in order to start driving the development roller 6 before the development roller 6 comes into contact with the drum 4 to develop the latent image on the drum 4, the cartridge P is provided with the development idler gear 100 (pivotally movable gear) which is pivotally movable like a pendulum. Further, in order to make it possible to begin driving the development roller 6 before the development roller 6 comes into contact with the drum 4, the cartridge P is structured so that the development idler gear 100, which is pivotally movable, begins to rotate the cleaning idler gear 101, by meshing with the cleaning idler gear 101 by the tip portion of their teeth (part (b)→part (c) of FIG. 9).

Therefore, it is possible to make the development idler gear 100 and cleaning idler gear 101 mesh with each other by the tip portions of their teeth in the early stage of the process through which the development roller 6 comes into contact with the drum 4. Thus, in order to increase the level of accuracy with which the development roller 6 and development idler gear 100 are positioned, the cartridge P is structured so that the development roller 6 and development idler gear are supported (by their axles) by the same member (common member), that is, the development covering member 32.

Next, referring to FIG. 1B, the structural arrangement for assuring that when the development unit 9 is in contact with the drum 4, the development roller 6 is in contact with the drum 4 is described. As the driving force from the development driving force outputting member 62 (part (b) of FIG. 3) of the apparatus main assembly 2 is transmitted to the development coupling outward gear 74*a* through the driving force transmitting portion 74*c*, the development coupling outward gear 74*a* rotates in the direction indicated by an arrow mark L.

In this case, the force which the development unit 9 receives as the gears mesh with each other equals to a combination of a force F3 which is generated by the meshing of development idler gear 100 with the cleaning idler gear 101, and a force F4 which is generated by the meshing of the cleaning idler gear 102 with the development coupling inward gear 74*b*. That is, both the forces F3 and F4 function as such forces that act in the direction to pivotally move the entirety of the development unit 9 in the direction indicated by the arrow mark W about the pivot X. Therefore, the development unit 9 is pressed upon the drum 4 in the direction parallel to the direction of the force F5, and also, it is assured that the development idler gear 100 and cleaning idler gear 101 mesh with each other.

[Modified Version]

By the way, the development idler gear 100 may be supported by a metallic bearing 103 instead of the development covering member 32 (FIG. 1), as shown in FIG. 10. The employment of the metallic bearing 103 increases the cartridge P in the accuracy in the distance between the axial lines of the two gears, and also, in strength, and therefore, stabilizes the cartridge P in the gear alignment. Therefore, it stabilizes the cartridge P in gear rotation. The bearing 103 is made up of a portion 103*b* formed of metallic plate, and a metallic shaft 103*a* crimped to the portion 103*b*. The development idler gear 100 is rotatably supported by the metallic shaft 103*a*. The driving force transmitting portion 74*c* of the development coupling outward gear 74*a* extends outward of the cartridge P through the opening 103*c* of the bearing 103.

Further, the gears for transmitting the driving force may be differently arranged from the arrangement in this embodiment. Next, referring to FIGS. 11A and 11B, the detail of this different arrangement is described. The driving force from the development driving force outputting member 62 (part (b) of FIG. 3) of the apparatus main assembly 2 is transmitted to the development coupling outward gear 74*a*, development idler gear 200, cleaning idler gear 201, development coupling inward gear 74*b*, and development roller gear 69, which are supported by the development unit 9. Thus, the development roller 6 rotates, and the toner on the development roller 6 is supplied to the drum 4.

Referring to FIG. 11A, referential codes 232, 232*b*, 232*d*, 232*e*, 224 and 224*b* stand for the members, and portions thereof, in this modified version, which correspond to the development covering member 32, cylindrical portion 32*b*, opening 32*d*, boss 32*e*, cartridge covering member 24 on the driven side, boss 24*b*, respectively, which are shown in FIG. 1A. The development idler gear 200 is rotatably held by the boss 232*e*, and the cleaning idler gear 201 is rotatably held by the boss 224*b*.

How the development unit 9 is placed in contact with, or separated from, the drum 4 is the same as the one described above. That is, as the development unit 9 is moved toward the drum 4 to be placed in contact with the drum 4, or moved away from the drum 4 to be separated from the drum 4, the development idler gear 200 meshes with the cleaning idler gear 201 to transmit the driving force to the cleaning idler gear 201, or separates from the cleaning idler gear 201 to stop transmitting the driving force to the cleaning idler gear 201.

Next, referring to FIG. 11B, the rotational directions of these gears are described. The gear arrangement shown in FIG. 11B is different from the one in FIG. 1A in that the former does not have the cleaning idler gear 102. The development coupling outward gear 74*a* rotates in the direction L1, which is opposite from the direction in which it is rotated to input the driving force. The development coupling outward gear 74*a* is in mesh with the development idler gear 200, and rotates the development idler gear 200 in the direction indicated by an arrow mark M1.

Further, as the development unit 9 is moved in the direction to be placed in contact with the drum 4, the development idler gear 200 meshes with the cleaning idler gear 201, and rotates the cleaning idler gear 201 in the direction indicated by the arrow mark N1. The cleaning idler gear 201 meshes with the development coupling inward gear 74*b* and rotates the development coupling inward gear 74*b* in the direction indicated by an arrow mark S1. Further, as the development roller gear 69 is rotated by the driving force from the development coupling inward gear 74*b*, the development roller 6 rotates in the direction indicated by the arrow mark U1.

Therefore, it is possible to eliminate one gear, making it possible to eliminate the space for this gear. That is, this modified version of this embodiment makes it possible to design the cartridge P so that the cartridge P occupies less space than the one in the original version of this embodiment.

However, the development coupling outward gear 74*a* rotates in the opposite direction from the one in which the development coupling outward gear 74*a* in the original version of this embodiment rotates. Therefore, the rotation of the development coupling outward gear 74*a* generates such force that works in the direction to separate the development roller 6 from the drum 4. Thus, in the case of this modified version of the first embodiment, providing the cartridge P with a pair of unshown spring assures that the development unit 9 is pressed toward the drum 4. That is, whether to reduce the cartridge P in gear count as in this modified version, or not to employ springs for pressing the development unit 9 toward the drum 4 as in the first embodiment can be optionally selected according to the positioning of the cartridges P in the apparatus main assembly 2.

Embodiment 2

Next, referring to FIGS. 12A, 12B, 12C, 13-15, the cartridge in the second embodiment of the present invention is described. The structural features of the cartridge in this embodiment, which are similar to those in the first embodiment are not described. In the following description of the second embodiment, each of the structural members of the cartridge P, and the portions thereof, are given a three digit referential number, the third digit of which is 3. If a given structural member, or the portion thereof, is the same as the counterpart in the first embodiment, it is given the same second and third digits, and suffixes as the counterpart.

[Structure of Driving Force Transmitting Portion]

[During Driving Force Transmission]

Referring to FIGS. 12A, 12B and 12C, the structure of the driving force transmitting portion is described. To begin with, the state of the cartridge P, in which the driving force is transmitted to the cartridge P is described. The cartridge P in this embodiment is provided with a development covering member 332, and a development coupling gear 374 which is a driving force input gear. The development covering member 332 and development coupling gear 374 are positioned in the listed order, between a bearing member 345, and a cartridge covering member 324, as the first supporting member, on the driven side.

One end of the development coupling gear 374 is provided with a driving force input portion 374*a*. The cartridge P is structured so that the driving force input portion 374*a* extends outward of the cartridge P through cartridge covering member 324, and receives the driving force from the development driving force outputting portion 62 (part (b) of FIG. 3) of the apparatus main assembly 2. The development coupling gear 374 is rotatably supported by the cartridge covering member 324 on the driven side. However, it may be supported by the drum unit 308.

The rotational axis of the development coupling gear 374 coincides with the pivot of the development unit 309. Hereafter, both the rotational axis of the coupling gear 374, and the pivot of the development unit 309, are referred to as a pivot X.

Further, the development unit 309 is provided with multiple gears which receive the driving force from the development coupling gear 374, and transmit the driving force to the development roller gear 369 for rotating the development roller 6. In this embodiment, one of these gears is an idler gear 351 (first gear), which meshes with the development coupling gear 374 and is positioned so that the distance between its axial line and the axial line of the development coupling gear 374 remains stable at a preset value. The idler gear 351 is connected to an idler gear 352 (second gear: pivotally movable gear) which is in mesh with the idler gear 351 and transmits the driving force to the development roller gear 369, by a connective member 380 as the second supporting member. The rectangular portions 380*a* and 380*b* of the connective member 380 hold the portions 380*c* and 380*d* of the connective member 380, which function as the axle for the idler gear 351 and that for the idler gear 352. That is, the idler gear 351 is rotatably held by the axle 380*c*, and the idler gear 352 is rotatably held by the axle 380*d*.

In this embodiment, the cartridge P is structured so that the idler gears 351 and 352 are sandwiched by the rectangular portions 380*a* and 380*b* of the connective member 380. However, the number of the rectangular portions may be only one (either portion 380*a* or 380*b*).

The axle 380*c* for the idler gear 351 is held by the cartridge cover 324 on the driven side. That is, the cartridge P is structured so that this connective member 380 is pivotally movable relative to the cartridge covering member 324 on the driven side, about the axle 380*c* for the idler gear 351. In other words, the cartridge P is structured so that the idler gear 352 is pivotally movable relative to the cartridge cover 324 on the driven side, about the idler gear 351.

By the way, the axle 380*c* for the idler gear 351 may be a component other than the axle 380*c*. For example, it may be one of the components of the drum unit 308. In such a case, the idler gear 352 is pivotally movable relative to the drum unit 308 about the axial line of the idler gear 351.

[Stopping and Starting of Driving Force Transmission]

[Stopping of Driving Force Transmission by Separation]

Next, referring to FIGS. 13A, 13B and 13C and 14, the operation to change the cartridge P in the state of operation, from the one in which the driving force is transmittable to the development roller 6, to the one in which the driving force is not transmittable to the development roller 6, is described. Here, FIG. 13A shows the state of the cartridge P, in which the development roller 306 is in contact with the drum 304. FIG. 13B shows the state of the cartridge P, in which the development roller 306 is not in contact with the drum 304, and the idler gear 352 is in mesh with the development roller gear 369 (opposing gear) (first state of separation). FIG. 13C shows the state of the cartridge P, in which the development roller 306 has separated farther from the drum 304, from where it is in FIG. 13B, and the idler gear 352 has separated from the development roller gear 369 (second state of separation).

When the cartridge P is in the state shown in FIG. 13A the development unit 309 is pivotally moved about the pivot X in the direction indicated by an arrow mark K, that is, the direction to separate the development roller 306 from the drum 304. Even after the development unit 309 begins to be pivotally moved relative to the drum unit 308 in the direction to separate the development roller 306 from the drum 304 when the cartridge P is in the state shown in FIG. 13A, the development coupling gear 374 continues to rotate by receiving the driving force from the apparatus main assembly 2 as it does when the drum unit 308 is in contact with the drum 304.

Until the development unit 309 pivotally moves to put the cartridge P in the state shown in FIG. 13B, the connective member 380 remains in the position into which it was moved in the direction indicated by an arrow mark W by being driven by the idler gear 351, for the following reason. That is, referring to FIG. 14, the cartridge P is structured so that in terms of the direction indicated by an arrow mark F20, that is, the direction of the force generated by the meshing of the idler gear 352 with the development roller gear 369, the pivot 380*c* of the connective member 380 is positioned on the drum unit 308 side. Therefore, the connective member 380 always remains under the moment which works in the direction indicated by the arrow mark W.

Therefore, as long as the idler gear 352 remains meshed with the development roller gear 369, the idler gear 352 remains in the position into which it was pivotally moved in the direction indicated by the arrow mark W, and continues to transmit the driving force to the development roller gear 69.

When the cartridge P is in the state shown in FIG. 13B, the development unit 309 is in the first separation position, in which the development roller 306 remains separated from the drum 304. Further, the connective member 380 which has pivotally moved in the direction indicated by the arrow mark W is in contact with a connective member catching portion 324*d*, with which the driven side cartridge cover 324 is provided to regulate the pivotal movement of the connective member 380, by its regulatory portion 380*e*, with which its rectangular portion 380*a* is provided. That is, because the moment generated in the direction indicated by the arrow mark W is caught by the connective member catching portion 324*d*, a preset amount of distance is maintained between the rotational axis of the idler gear 352 and that of the development roller gear 369, and therefore, it is assured that the two gears 352 and 369 remain properly meshed.

By the way, in this embodiment, the connective member catching portion 324*d* is a part of the driven side cartridge cover 324. However, it may be a part of the a component other than the driven side cartridge cover 324. For example, it may be a part of the drum unit 308. Further the regulatory portion 380*e* which bumps into the connective member catching portion 324*d* is a part of the rectangular portion 380*a*. However, the regulatory portion 380*e* does not need to be a part of the rectangular portion 380*a*. For example, it may be a part of the rectangular portion 380*b*, or an extension of the axle 380*d* of the idler gear 352.

As the cartridge P is changed in the state of operation from the one shown in FIG. 13B to the one shown in FIG. 13C, the development unit 309 is pivotally moved by a main assembly cam 80, to a position θ2, in terms of the direction of the pivotal movement of the development unit 309. At this point in time, the development unit 309 is in the second separation position, in which the distance between the development roller 306 and drum 304 is greater than when the development unit 309 is in the first separation position.

However, the regulatory portion 380*e* is under the regulation from the connective member catching portion 324*d*. Therefore, the idler gear 352 is kept in the position shown in FIG. 13B, being prevented from moving further in the direction indicated by the arrow mark W. That is, the idler gear 352 is prevented from following the pivotal movement of the development roller gear 369. Consequently, the tip of the tooth of the idler gear 352 separates from the tip of the development roller gear 369 as far as a distance of ES, preventing thereby the driving force from being transmitted to the development roller gear 369.

[Driving Force Transmission by Connection]

Next, the process through which the cartridge P is changed in its state of operation, from the one in which the driving force is not transmittable to the development roller 306, to the one in which the driving force is transmittable. As described above, while the development unit 309 is changed in state, from the one shown in FIG. 13C to the one shown in FIG. 13B, the development roller 306 is pivotally moved toward the drum 304, that is, in the direction indicated by the arrow mark H, about the pivot X, by being pressed by the compression spring 95 as a pressing member shown in FIG. 5. By the way, both FIGS. 13C and 13B show the same state of the cartridge P, in which the development roller 306 is separated from the drum 304.

As the development unit 309 pivotally moves into the state shown in FIG. 13B, the development roller gear 369 pivotally moves in the direction indicated by the arrow mark H, that is, toward the idler gear 352 which has been regulated by the connective member catching portion 324*d*. Thus, one of the teeth of the development roller gear 369 begins to mesh with one of the teeth of the idler gear 352. Consequently, the development roller gear 369 meshes with the idler gear 352 as described with reference to FIG. 9. Thus, the driving force is transmitted to the development roller gear 369.

Then, as the development unit 309 is further changed in state into the one shown in FIG. 13A, the development roller 306 is made to come into contact with the drum 304 by the combination of the pressure from the compression springs 95, and the moment generated as the driving force is inputted into the development coupling gear 374 from the apparatus main assembly 2.

It is desired that the development roller gear 369 and idler gear 352 are positioned so that the force generated by the driving force after the meshing of the development roller gear 369 and idler gear 352 with each other works in the direction to make the development roller 306 come into contact with the drum 304. More concretely, as long as the pivot X of the development unit 309 is on the development roller gear 369 side of the extension of the arrow mark F2 in FIG. 14, which indicates the direction of the force generated by the driving force and meshing between the idler gear 352 and development roller gear 369, the moment, the direction of which is indicated by the arrow mark H, that is, the direction in which the development unit 309 pivotally moves, acts on the development unit 309. Thus, the development unit 309 is pressed toward the drum 304.

With the cartridge P being structured as described above, the compression springs 95 may be eliminated, or replaced with ones which are less in resiliency, in order to reduce the cartridge P (image forming apparatus 1) in cost.

By the way, in this embodiment, while the development roller 306 is separated from the drum 304, or placed in contact with the drum 304, that is, while the cartridge P is changed in state from the one shown in FIG. 13A to the one shown in FIG. 13B, the positional relationship between the idler gear 352 and development roller gear 369, in terms of the teeth-to-teeth contact, was preset. However, in order to control the distance between the rotational axes of the two gears, the development unit 309, for example, may be provided with a regulating portion for regulating in position, the idler gear 352 which is pivotally movable. With the provision of the regulating portion, it is possible to keep more stable, the distance between the rotational axes of the two gears 352 and 369.

As described above, usage of the structural arrangement in this embodiment described above makes it possible to cause the development roller 306 to begin rotating before the development roller 306 comes into contact with the drum 304.

[Modified Version]

One of the modifications of this embodiment is described with regard to the structure of the cartridge P (image forming apparatus 1). In this embodiment, the cartridge P is structured so that the pivot X coincides with the rotational axis of the development coupling gear 374. Thus, it is possible to structure the cartridge P to position the development coupling gear 374 between the development unit covering member 332 and bearing member 345. In such a case, the development unit covering gear 374 is supported by the development unit 309. That is, since the cartridge P is structured so that the rotational axis coincides with the pivot X, it does not matter which is provided with the unit coupling gear (374), development unit 309 or drum unit 308.

Further, in this embodiment, the cartridge P was structured so that the development coupling gear 374 is positioned between the development covering member 332 and the driven side cartridge cover 324. In this case, the pivot X' may be other axis than the pivot X which coincides with the rotational axis of the development coupling gear 374. For example, it is possible to structure the cartridge P so that a shaft 332*f* which is protrusive from the development covering member 332 functions as the pivot X', and the driven side cartridge cover 324 is pivotally supported by the shaft 332*f* to allow the drum unit 308 to pivot about the shaft 332*f*. In this case, the development coupling gear 374 is rotatably supported by the cylindrical portion 234*a* of the driven side cartridge cover 324.

Further, in this embodiment, the structural arrangement for allowing the connective member 380 and idler gear 352 to pivotally move shaft 332*f* may be such that the cartridge P is provided with an assistance springs for pressing the development roller gear 369 toward the development roller gear 369 to make the development roller gear 369 pivotally move.

Further, two or more gears may be placed between the development coupling gear 374 and development roller gear 369.

Embodiment 3

Next, referring to FIGS. 16-18, the cartridge P in this embodiment is described. By the way, the structural features of the cartridge in this embodiment, which are similar to those in the first embodiment are not described.

In the following description of this embodiment, each of the structural members of the cartridge P, and the portions thereof, are given a three digit referential number, the third digit of which is 4. If a given structural member, or one of the portions thereof, is the same in structure as the counterpart in the first embodiment, it is given the same referential code as the second and third digits, and suffixes, as the counterpart.

[Structure of Driving Force Transmitting Portion]

[When Driving Force is Transmitted]

Next, referring to FIG. 16, the connection between the development unit and drum unit is described. First, the state of the cartridge P, in which the cartridge P is when driving force is transmittable to the drum unit is described. The difference of this embodiment from the second embodiment is that in this embodiment, the axis about which the connective member 480 pivotally moves belongs to the development unit 409, instead of the drum unit 408.

The idler gear 451 is positioned so that it is allowed to mesh with the development coupling gear 474, and also, that while the idler gear 451 is in mesh with the development coupling gear 474, a preset amount of distance is maintained between the rotational axes of the two gears 451 and 474. The idler gear 451 is connected by connective member 480, to the idler gear 452 (pivotally movable gear) which transmits the driving force to the development roller gear 469 by meshing with the idler gear 451.

The rectangular portions 480*a* and 480*b* of the connective member 480 hold the axles 480*c* and 480*d* which rotatably support the idler gear 451 and 452, respectively. That is, the idler gear 451 is rotatably supported by the axle 480*c*, and the idler gear 452 is rotatably supported by the axle 480*d*. In this embodiment, the cartridge P is structured so that the idler gear 451 and idler gear 452 are sandwiched by the rectangular portions 480*a* and 480*b* of the connective member 480. However, the cartridge P may be structured so that the two gears 451 and 452 are supported by only one of the rectangular portions 480*a* and 480*b*.

The axle 480*c* for the idler gear 451 is held by the development covering member 432. That is, the cartridge P is structured so that this connective member 480 is pivotally movable relative to the development covering member 432 about the axle 480*c* for the idler gear 451. In other words, the cartridge P is structured so that the idler gear 452 is pivotally movable relative to the development covering member 432 about the rotational axis of the idler gear 451. By the way, the axle 480*c* for the idler gear 451 may be a component other of the cartridge P than the axle 480*c*. For example, it may be a part of the bearing member 445.

[Stopping and Starting of Driving Force Transmission]

[Stopping of Driving Force Transmission, by Separation of Development Unit from Drum]

Next, referring to FIGS. 17A, 17B and 17C, the process for changing the cartridge P in state, from the one in which the driving force is transmitted to the development roller 406, to the one in which the driving force is not transmitted to the development roller 406 is described. FIG. 17A shows the state of the cartridge P, in which the development roller 406 is in contact with the drum 404. FIG. 17B shows the state of the cartridge P, in which the development roller 406 has separated from the drum 404, and yet, the idler gear 452 remains meshed with the development roller gear 469. FIG. 17C shows the state of the cartridge P, in which the development roller 406 has separated farther from the drum 404 than in the state shown in FIG. 17B, and therefore, the idler gear 452 (pivotally movable gear) has separated from the development roller gear 469 (opposing gear).

As the cartridge P is changed in state from the one shown in FIG. 17A to the one shown in FIG. 17B, the development unit 409 is pivotally moved in the direction indicated by the arrow mark K, that is, the direction to separate the development unit 409 from the drum 404 of the drum unit 408. During the pivotal movement of the development unit 409, the idler gear 451 also pivotally moves in the direction indicated by the arrow mark K about the pivot X. Further, the idler gear 452 is pivotally moved by the driving force, in the direction indicated by the arrow mark W about the axis of the shaft 480*c* of the idler gear 451. Further, the idler gear 452 and development roller gear 469 remain meshed with each other, and therefore, the driving force is being transmitted to the development roller gear 469.

Referring to FIGS. 17A, 17B and 17C and 18, described next is the process for stopping the transmission of the driving force to the drum unit 408 while the cartridge P is changed in state from the one shown in FIG. 17B to the one shown in FIG. 17C in which the development unit 409 is separated farther from the drum 404 than in FIG. 17B. The driven side cartridge cover 424 is provided with a connective member catching surface 424*d* (which functions like cam surface), as a portion for regulating the pivotal movement of the development unit 409. Further, the rectangular portion 480*a* of the connective member 480 is provided with a regulatory portion 480*e* which bumps into the connective member catching surface 424*d*.

FIG. 18 is a schematic drawing which shows how the distance between the pivot X and the rotational axis of the idler gear 452 is changed by the connective member catching surface 424*d*. While the development unit 409 is separated from the drum 404, the idler gear 452 remains pressured toward the surface 424*d* by the force from the idler gear 452 which is pivotally moving in the direction indicated by the arrow mark W as described above. Therefore, the idler gear 452 is guided by the surface 424*d* to the position shown in part (b) of FIG. 18, in coordination with the movement of the idler gear 451.

While the idler gear 452 pivotally moves from where it is when the cartridge P is in the state shown in FIG. 17A to the one in FIG. 17B, the distance between the idler gear 452 and pivot X remains the same (d1).

While the idler gear 452 moves from where it is in part (a) of FIG. 18 to the one in part (b) of FIG. 18, it is guided by the connective member catching surface 424*d* which regulates the direction K in which the regulatory portion 480*e* is pivotally moved, in such a manner that the distance between the idler gear 452 and pivot X increases from d1 to d2. Further, the development roller gear 469 pivotally moves from θ3 in part (a) of FIGS. 18 to 024 in part (b) of FIG. 18. At the same time, the axle 480*c* for the idler gear 451 also pivotally moves from θ21 to θ22.

The axle 480*c* for the idler gear 451 is a part of the development covering member 432, which pivotally moves with the development unit 409. Therefore, θ22−θ21=θ24−θ23.

Although the idler gear 451 pivotally moves in the direction indicated by the arrow mark K as described above, the idler gear 452 is prevented by the connective member catching surface 424*d* from following the pivotal movement of the development roller gear 469 (d2>d1). Therefore, the tip of the tooth of the idler gear 452 separates from that of the development roller gear 469 as far as ES. Therefore, the driving force transmission is stopped.

In this embodiment, it is the rectangular portion 480*a* that is provided with the regulatory portion 480*e* which bumps into the connective member catching surface 424*d*. However, this setup is not mandatory. For example, it may be rectangular portion 480*b*, or an extension of the axle 480*d* for the idler gear 452. By the way, in this embodiment, the surface 424*d* is a part of the driven side cartridge cover 424. However, it may be a part of a component other than the driven side cartridge cover 424. For example, it may be a part of the drum unit 408.

[Starting of Driving Force Transmission, by Placement of Development Unit in Contact with Drum]

Next, the process through which the cartridge P is changed in state from the one in which the driving force is not transmitted to the development roller 406, to the one in which the driving force is transmitted to the development roller 406. While the cartridge P is changed in state from the one shown in t FIG. 17C to the one shown in FIG. 17B, the development roller 406 pivotally moves about the pivot X in the direction indicated by the arrow mark H, that is, toward the drum 404, by being pressed by the compression springs 95, as pressing members, shown in FIGS. 4 and 5, as described above. By the way, both when the cartridge P is in the state shown in FIG. 17C or 17B, the development roller 406 is not in contact with the drum 404.

As the development unit 409 pivotally moves into the position shown in FIG. 17B, the idler gear 452 held by the connective member 480 which has returned following the connective member catching surface 424*d*, meshes with the development roller gear 469. Thus, the driving force is transmitted to the development roller gear 469.

While the development unit 409 is pivotally moved further into the position shown FIG. 17A, it is made to pivotally move by a combination of the pressure from the compression spring 409, and the moment generated in the direction indicated by the arrow mark H by the driving force which has been inputted into the development coupling gear 474 from the apparatus main assembly 2. Consequently, the development roller 406 comes into contact with the drum 404.

Also in this embodiment, it is desired that the development roller gear 469 and idler gear 452 are positioned so that the force generated as the development roller gear 469 and idler gear 452 is directed to make the development roller 406 come into contact with the drum 404 as in the second embodiment. By structuring the cartridge P as the cartridge P is structured in this embodiment, it is possible to make the development roller 406 begin rotating before the development roller 406 comes into contact with the drum 404.

By the way, also in this embodiment, the development unit 409, for example, may be provided with the regulating portion for regulating the idler gear 452 in position while the idler gear 452 pivotally moves.

[Modified Version]

This embodiment also is modifiable as the second embodiment 2 was as described above. That is, it is possible change the cartridge P in the position of the development coupling gear 474, or the pivot of the development unit 409. Further, the cartridge P may be provided with assistant springs for pressing the idler gear 452 in the pivotally moving direction as in the second embodiment. Further, two or more gears may be positioned between the development coupling gear 474, and the gear which meshes with the development roller gear 469.

Embodiment 4

Next, referring to FIGS. 19-21, the cartridge P in the fourth embodiment of the present invention is described. By the way, the structural features of the cartridge P in this embodiment, which are similar to those in the first embodiment are not described. In the following description of this embodiment, each of the structural members of the cartridge P, and each of the portions thereof, are given a three digit referential code, the third digit of which is 5. If a given structural member, or the portion thereof, is the same in structure as the counterpart in the first embodiment, it is given the same second and third digits, and suffixes, as the counterpart.

[Structure of Driving Force Transmitting Portion]

[During Transmission of Driving Force]

First, referring to FIG. 19, the structure of the driving force transmitting portion is described. To begin with, the state of the cartridge P, in which the driving force is transmitted to the development roller, is described. The difference of this embodiment from the third one is that the line (pivot) about which the connective member 580 pivots coincides with the rotational axis of the idler gear 552, instead of the idler gear 551. Thus, the surface 524*d*, which regulates the pivotal movement of the development unit 509 while the development unit 509 moves from where it is when the distance between the development roller 506 of the development unit 509 and drum 504 is largest, to where it is when the development unit 509 is in contact with the drum 504, is different from the surface 524*f* which guides development unit 509 when the development unit 509 is pivotally moved from where it is in contact with the drum 504 to where the distance between the development unit 509 and drum 504 is largest.

The idler gear 551 which meshes with the development coupling gear 574, and the idler gear 552 which meshes with the idler gear 551 to transmit the driving force to the development roller gear 569, are connected by the connective member 580. In this embodiment, the cartridge P is structured so that the distance between the rotational axis of the idler gear 442 and that of the development roller gear 569 remains stable. The member by which the idler gears 551 and 552 are connected to each other may be only one of the rectangular portions 580*a* and 580*b*.

The axle 580*d* by which the idler gear 552 is rotatably supported is held by the development covering member 532. That is, the cartridge P is structured so that the connective member 580 is pivotally movable about the axis of the axle 580*d*, relative to the development covering member 532. In other words, the cartridge P is structured so that the idler gear 551, which is pivotally movable gear, is pivotally movable about the axial line of the idler gear 552, relative to the development covering member 532. Also in this embodiment, the component which has the axle 580*d* for the idler gear 552 may be a component other than the axle 580*d*. For example, it may be the bearing member 545.

[Operation to Start Transmitting Driving Force, and Operation to Stop Transmitting Driving Force]

[Stopping of Driving Force Transmission, by Separation of Development Unit from Drum]

Next, referring to FIGS. 20A, 20B, 20C and 21, the sequence through which the cartridge P is changed in state from the one in which the driving force is transmitted to the development roller, to the one in which the driving force is not transmitted to the development roller is described. FIG. 20A shows the state of the cartridge P, in which the development roller 506 is in contact with the drum 504. FIG. 20B shows the state of the cartridge P, in which the development roller 506 has separated from the drum 504, and the idler gear 551 and development coupling gear 574 remains meshed with each other. FIG. 20C shows the state of the cartridge P, in which the development roller 506 has separated farther from the drum 504, and idler gear 551 (pivotally movable gear) has separated from the development coupling gear 574 (opposing gear).

FIG. 21 shows the positional relationship between the guiding surfaces 524*d* and 524*f*, regulatory portion 580*e* of the rectangular portion 580*a*, that is, the positional relationship between the idler gear 551 and development coupling gear 574 (pivot X), when the cartridge P is in each of the states shown in FIGS. 20A, 20B and 20C. Part (a) of FIG. 21 shows the state of the cartridge P, in which the idler gear 551 and development coupling gear 574 are in mesh with each other. Part (b) of FIG. 21 shows the state of the cartridge P, in which the idler gear 551 has separated from the development coupling gear 574. Part (c) of FIG. 21 shows the state of a combination of the guiding surface 524*d* and regulatory portion 580*e* when the cartridge P is in the state shown in FIG. 20A. Part (d) of FIG. 21 shows the state of the combination of the guiding surface 524*f* and regulatory portion 580*e* when the cartridge P is in the state shown in FIG. 20B.

Described next is only the difference of this embodiment from the third embodiment, regarding the pivotal movement of the development unit 509 from where the development unit 509 is when the cartridge P is in the state shown in FIG. 20B to where it is when the cartridge P is in the state shown in FIG. 20C As the development unit 509 is pivotally moved about the pivot X from where it is when the cartridge P is in the state shown in FIG. 20B to where it is in the state shown in FIG. 20C, the axle 580*d*, about which the connective member 580 of the development covering member 532 pivotally moves, moves about the pivot X in the direction indicated by the arrow mark K (part (c) of FIG. 21).

During this movement of the development unit 509, the regulatory portion 580*e* bumps into the guiding surface 524*d* of the cartridge cover 524 on the driven side. Consequently, the development unit 509 is made to pivot in the direction indicated by the arrow mark K. That is, the idler gear 551 is not allowed to pivot in the direction indicated by the arrow mark K, being therefore changed in direction so that it moves in the direction indicated by the arrow mark W, shown in part (c) of FIG. 21, following the guiding surface 524*d*.

Also during this movement of development unit 509, the distance between the axial line of the development coupling gear 574 and that of the idler gear 551 increases from d3 to d4 (d4>d3). Thus, the distance between the tip of the tooth of the idler gear 551 and that of the development coupling gear 574 increases to ES, preventing thereby the driving force from being transmitted from the idler gear 551 to the development coupling gear 574. By the way, in this embodiment, the cartridge P is structured so that the guiding surface 524*d*, and a guiding surface 524*f* which will be described later, face the recess 524*h* (or hole) with which the cartridge cover 524 on the driven side is provided.

Also in this embodiment, the cartridge P may be structured so that a part of the rectangular portion 580*b* of the connective member 580, or a part of the extension of the axle 580*c* for the idler gear 551, functions as the regulatory portion 580*e*. Further, it may be a component other than the cartridge cover 524 on the driven side than is provided with the guiding surfaces 524*d* and 524*f*.

[Starting of Driving Force Transmission, by Placement of Development Unit in Contact with Drum]

Next, the sequence for changing the cartridge P in state from the one in which the driving force is not transmitted from the development unit 509 to the drum unit 508, to the one in which the driving force is transmitted from the development unit 509 to the drum unit 508 is described. As the cartridge P is changed in state from the one shown in FIG. 20C to the one shown in FIG. 20B, the development unit 509 pivotally moves about the pivot X, in the direction indicated by the arrow mark H, that is, the direction in which the development roller 506 moves toward the drum 504, as described above, by being pressed by the compression springs 95 as pressure applying members shown in FIGS. 4 and 5. By the way, FIGS. 20C and 20B show the same state of the cartridge P, in which the development roller 506 are not in contact with each other.

While the cartridge P is changed in state from the one shown in FIG. 20C to the one shown in FIG. 20B, the development coupling gear 574 and idler gear 551 are not in mesh with each other. Therefore, the driving force does not transmit from the development coupling gear 574 to the idler gear 551. Therefore, the cartridge cover 524 is provided with the guiding surface 524*f* for reducing the distance between the axial line of the idler gear 551 and that of the development coupling gear 574 from d4, to d3 which enables the two gears 574 and 551 to mesh with each other, while the development unit 509 pivotally moves in the direction indicated by the arrow mark H.

As the development unit 509 pivotally moves in the direction indicated by the arrow mark H, the idler gear 552 also pivotally moves in the direction indicated by the arrow mark H, causing the connective member 580 to pivotally move with the idler gear 552. Thus, the regulatory member 580*e* with which the rectangular portion 580*a* of the connective member 580 is provided bumps into the guiding surface 524*f*, shown in part (d) of FIG. 21, being thereby regulated in position. Thus, it moves in the direction indicated by an arrow mark T, from where it is when the cartridge P is in the state shown in part (d) of FIG. 21 to where it is when the cartridge P is in the state shown in part (c) of FIG. 21. Consequently, the distance between the rotational axis of the idler gear 551 (pivotally movable gear) and development coupling gear 574 (opposing gear) mesh with each other, making it possible for the driving force to be transmitted to the development roller gear 569 by way of the idler gear 552.

While the cartridge P is further changed in state to be put in the state shown in FIG. 20A, the development unit 509 is pivotally moved by the combination of the pressure from the compression springs 95, and the moment generated the driving force inputted into the development coupling gear 574 from the apparatus main assembly 2 and transmitted to the development unit 509. It is desired that the cartridge P is structured so that also during this period, the force generated as the development roller gear 569 and idler gear 552 mesh with each other works in the direction to cause the development roller 506 to come into contact with the drum 504. By structuring the cartridge P (image forming apparatus 1) as described above, it is possible to make the development roller 506 begin to rotate before the development roller 506 comes into contact with the drum 504.

By the way, also in this embodiment, it may be the development unit 509, for example, that is provided with a portion for regulating in position, the idler gear 551, which is enabled to pivotally move, in order to keep a proper (preset) distance between the axial line of the idler gear 551 and that of the development coupling gear 574, as in the third embodiment.

[Modified Versions]

This embodiment also is modifiable in the same manner as the embodiments 2 and 3, in the position of the development coupling gear 574 and/or rotational axis of the development unit 509. Further, also in this embodiment, the cartridge P may be provided with assistant springs for pressing the idler gear 551, as in the second and third embodiments. Further, the cartridge P may be structured so that two or more gears are placed between the idler gear 551 and development roller gear 569.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-045189 filed on Mar. 13, 2018, which is hereby incorporated by reference herein in its entirety.

What is claimed is:

1. A cartridge detachably mountable to a main assembly of an image forming apparatus, the cartridge comprising:

a drum unit including a photosensitive drum;

a developing unit including:

a developing roller, a driving force receiving portion for receiving a driving force for rotating the developing roller from the main assembly, and a development gear fixed at a longitudinal end portion of the developing roller, wherein the developing unit is connected to the drum unit so as to move, with respect to the drum unit, between a contact position in which the developing roller contacts the photosensitive drum and a spaced position in which the developing roller is spaced from the photosensitive drum;

a driving train configured to transmit the driving force received from the driving force receiving portion to the development gear, wherein the driving train includes a first driving portion connected to the driving force receiving portion so as to receive the driving force from the driving force receiving portion, and a second driving portion configured to receive the driving force from the first driving portion and to transmit the driving force toward the development gear, wherein the developing unit includes the first driving portion, and the drum unit includes the second driving portion, wherein the first driving portion is movable, with respect to the drum unit, in conjunction with a movement of the developing unit between the contact position and the spaced position such that when the developing unit is in the contact position, the first driving portion and the second driving portion are connected with each other so as to transmit the driving force from the first driving portion to the second driving portion, and such that when the developing unit is in the spaced position, the first driving portion and the second driving portion are not connected with each other to prevent the driving force from being transmitted to the second driving portion from the first driving portion.

2. A cartridge according to claim 1, wherein the developing unit is rotatable about a rotational axis between the contact position and the spaced position, and the driving force receiving portion is rotatable about the rotational axis, wherein the first driving portion includes a first gear portion integrally rotatable with the driving force receiving portion about the rotational axis, a second gear rotatable about the rotational axis independently of the driving force receiving portion and the first gear portion to transmit the driving force to the development gear, and a swingable gear that is in meshing engagement with the first gear portion, wherein the second driving portion is capable of transmitting the driving force received from the swingable gear, to the second gear, and wherein, when the developing unit is in the contact position, the swingable gear is in a first position in which the swingable gear is connected to the second driving portion, and, when the developing unit is in the spaced position, the swingable gear is in a second position in which the swingable gear is not connected to the second driving portion.

3. A cartridge according to claim 2, wherein the second driving portion includes a third gear engageable with the swingable gear, and a fourth gear engageable with both of the third gear and the second gear, and wherein the fourth gear is arranged to engage with the third gear and the second gear regardless of a position of the developing unit.

4. A cartridge according to claim 3, wherein the third gear is a high-tooth gear.

5. A cartridge according to claim 2, wherein the swingable gear is a high-tooth gear.

6. A cartridge according to claim 2, wherein the second gear is in meshing engagement with the development gear.

7. A cartridge according to claim 1, wherein a time that drive of developing roller starts is before the developing unit reaches to the contact position.

8. A cartridge according to claim 1, wherein the drum unit includes a side frame by which the developing unit is supported rotatably, and wherein the side frame supports the second driving portion.

* * * * *